US010876353B2

(12) United States Patent
Hummel et al.

(10) Patent No.: US 10,876,353 B2
(45) Date of Patent: Dec. 29, 2020

(54) BLIND TILT ADJUSTMENT ASSEMBLY

(71) Applicant: ODL, Incorporated, Zeeland, MI (US)

(72) Inventors: Benjamin Patrick Hummel, Rockford, MI (US); Frederick John Hering, III, Clarendon Hills, IL (US)

(73) Assignee: ODL, Incorporated, Zeeland, MI (US)

( * ) Notice: Subject to any disclaimer, the term of this patent is extended or adjusted under 35 U.S.C. 154(b) by 301 days.

(21) Appl. No.: 16/003,833

(22) Filed: Jun. 8, 2018

(65) Prior Publication Data

US 2018/0355661 A1 Dec. 13, 2018

Related U.S. Application Data

(60) Provisional application No. 62/517,488, filed on Jun. 9, 2017.

(51) Int. Cl.

| | |
|---|---|
| ***E06B 9/264*** | (2006.01) |
| ***E06B 9/307*** | (2006.01) |
| ***E06B 9/322*** | (2006.01) |

(52) U.S. Cl.

CPC ..... *E06B 9/264* (2013.01); *E06B 9/307* (2013.01); *E06B 9/322* (2013.01); *E06B 2009/2646* (2013.01)

(58) Field of Classification Search

CPC ..... E06B 9/264; E06B 9/307; E06B 9/322; E06B 2009/2646

See application file for complete search history.

(56) References Cited

U.S. PATENT DOCUMENTS

| | | | | | |
|---|---|---|---|---|---|
| 2,389,956 | A * | 11/1945 | Castilonia | E06B 9/302 | 160/172 R |
| 2,687,770 | A * | 8/1954 | Brooks | E06B 9/303 | 160/176.1 R |
| 3,795,267 | A * | 3/1974 | Debs | E06B 9/264 | 160/168.1 R |
| 4,480,674 | A * | 11/1984 | Anderson | E06B 9/264 | 160/107 |
| 4,588,012 | A * | 5/1986 | Anderson | E06B 9/264 | 160/107 |
| 4,621,673 | A * | 11/1986 | Georgopoulos | E06B 9/32 | 160/168.1 R |
| 5,103,888 | A * | 4/1992 | Nakamura | E06B 9/308 | 160/171 |
| 5,228,491 | A * | 7/1993 | Rude | E06B 9/307 | 160/168.1 R |

(Continued)

*Primary Examiner* — James M Ference

(74) *Attorney, Agent, or Firm* — Barnes & Thornburg, LLP

(57) ABSTRACT

A blind assembly includes a headrail, a guide member carried by the headrail and defining a channel therethrough, a tilt basket received within the channel, first and second cords operatively engaging a number of blind slats and extending from the number of slats upwardly through the tilt basket with the first cord coupled to the guide member adjacent to one terminal end of the channel and the second cord coupled to the guide member adjacent to an opposite terminal end of the channel, and an actuator to cause relative movement between the tilt basket and the elongated guide member along the channel to adjust a tilt angle of the number of slats between a full forward tilt with the tilt basket abutting one terminal end of the channel and a full rearward tilt with the tilt basket abutting the opposite terminal end of the channel.

21 Claims, 12 Drawing Sheets

(56) References Cited

U.S. PATENT DOCUMENTS 5,465,779 A * 11/1995 Rozon ..... E06B 9/326 160/168.1 V
5,497,820 A * 3/1996 Drake, III ..... E06B 9/307 160/107
5,934,351 A * 8/1999 Bharucha ..... E06B 9/307 160/176.1 R
6,481,486 B1 * 11/2002 Sanz ..... B64C 1/1484 160/107
6,571,853 B1 * 6/2003 Ciuca ..... E06B 9/322 160/170
6,915,831 B2 * 7/2005 Anderson ..... E06B 9/322 160/173 R
6,932,139 B2 * 8/2005 Early ..... E06B 9/264 160/107
7,000,670 B2 * 2/2006 Kwon ..... E06B 9/264 160/107
7,100,664 B2 * 9/2006 Hsu ..... E06B 9/303 160/115
7,159,636 B2 * 1/2007 Liang ..... E06B 9/30 160/115
7,198,089 B2 * 4/2007 Hsu ..... E06B 9/322 160/170
7,331,370 B1 * 2/2008 Militello ..... E06B 9/322 160/170
7,343,957 B2 * 3/2008 Lin ..... E06B 9/262 160/168.1 R
7,703,500 B2 * 4/2010 Wen ..... E06B 9/323 160/173 R
7,987,890 B2 * 8/2011 Wilson ..... E06B 9/303 160/176.1 R
8,919,416 B2 * 12/2014 Chen ..... E06B 9/322 160/170
9,127,497 B2 * 9/2015 Safarik ..... E06B 9/26
9,574,393 B2 * 2/2017 Huang ..... E06B 9/322
2003/0024656 A1 * 2/2003 Ciuca ..... E06B 9/303 160/170
2003/0066614 A1 * 4/2003 Sun ..... E06B 9/264 160/107
2003/0075285 A1 * 4/2003 Anderson ..... E06B 9/264 160/90
2003/0127196 A1 * 7/2003 Corey ..... E06B 9/32 160/84.05
2004/0069417 A1 * 4/2004 Sun ..... E06B 9/304 160/107
2004/0211528 A1 * 10/2004 Jin ..... E06B 9/264 160/107
2004/0226665 A1 * 11/2004 Berger ..... E06B 9/32 160/107
2006/0260765 A1 * 11/2006 Antonini ..... E06B 9/322 160/168.1 R
2007/0017644 A1 * 1/2007 Berger ..... E06B 3/04 160/107
2007/0095486 A1 * 5/2007 Huang ..... E06B 9/308 160/171
2008/0216966 A1 * 9/2008 Ben-David ..... E06B 9/264 160/167 R
2008/0283200 A1 * 11/2008 Hummel ..... E06B 9/264 160/107
2011/0315329 A1 * 12/2011 Hong ..... E06B 9/322 170/340
2012/0111509 A1 * 5/2012 Mullet ..... E06B 9/308 160/331
2012/0118515 A1 * 5/2012 Chen ..... E06B 9/326 160/170
2013/0048234 A1 * 2/2013 Dahl ..... E06B 9/388 160/171
2013/0255890 A1 * 10/2013 Mullet ..... E06B 9/322 160/168.1 P
2014/0020851 A1 * 1/2014 Ouzts ..... E06B 9/264 160/107
2014/0208652 A1 * 7/2014 Kirk ..... E06B 9/264 49/67
2014/0332170 A1 * 11/2014 Chang ..... E06B 9/322 160/84.02
2015/0284990 A1 * 10/2015 Hall ..... E06B 9/74 74/606 R
2015/0361718 A1 * 12/2015 Hummel ..... E06B 9/78 160/189
2016/0222722 A1 * 8/2016 Schulman ..... E06B 9/68
2018/0355661 A1 * 12/2018 Hummel ..... E06B 9/322

* cited by examiner

BLIND TILT ADJUSTMENT ASSEMBLY

CROSS-REFERENCE TO RELATED APPLICATION

This application claims the benefit of and priority to U.S. provisional patent application Ser. No. 62/517,488 filed Jun. 9, 2017, the disclosure of which is expressly incorporated herein by reference.

FIELD OF THE INVENTION

The present invention relates generally to blind systems for windows and/or doors, and more specifically to blind systems mounted and encapsulated within an insulated glass (IG) unit.

BACKGROUND

Some conventional tilting blind assemblies are mountable to window frames and/or to windows openings in doors. Other conventional tilting blind assemblies are mounted and encapsulated within insulated glass (IG) units comprising two or more spaced-apart panels. In either case, improvements in tilt and/or raising/lowering control structures are desirable to provide for improved operation and/or to provide for ease of manufacture and/or assembly.

SUMMARY

The present invention may comprise one or more of the features recited in the attached claims, and/or one or more of the following features and combinations thereof. In one aspect, a blind assembly for a window or door may comprise an elongated headrail extendable along or adjacent to a top of a window frame or a top edge of a window opening in a door, an elongated guide member carried by the headrail, the guide member defining a channel therethrough extending axially along the guide member parallel with a longitudinal direction of the headrail, the channel having a first terminal end and a second terminal end opposite the first terminal end, a tilt basket received within the channel and defining a bore therethrough substantially normal to the axial direction of the channel, first and second cords operatively engaging a number of blind slats, the first and second cords extending from the number of slats upwardly through the bore of the tilt basket with the first cord coupled to the guide member adjacent to the first terminal end of the channel and the second cord coupled to the guide member adjacent to the second terminal end of the channel, and an actuator to cause relative movement along the channel between the tilt basket and the elongated guide member to adjust a tilt angle of the number of slats between a full forward tilt with the tilt basket abutting the first terminal end of the channel and a full rearward tilt with the tilt basket abutting the second terminal end of the channel.

In another aspect, a blind assembly for a window or door may comprise an elongated headrail extendable along or adjacent to a top of a window frame or a top edge of a window opening in a door, a plurality of tilt baskets spaced apart along and non-movably mounted to the headrail, each of the plurality of tilt baskets defining a bore therethrough, a plurality of elongated guide members each defining a channel therethrough extending axially therealong parallel with a longitudinal direction of the headrail, each channel having a first terminal end, a second terminal end opposite the first terminal end and one of the plurality of tilt baskets received therein with the bore defined therethrough substantially normal to the axial direction of the channel, a plurality of sets of first and second cords operatively engaging a number of blind slats, each of the plurality of sets of first and second cords extending from the number of slats upwardly through the bore of a different one of the plurality of tilt baskets with the first cord coupled to a corresponding one of the plurality of guide members adjacent to the first terminal end of the channel defined therethrough and the second cord coupled to the corresponding one of the plurality of guide members adjacent to the second terminal end of the channel defined therethrough, and an actuator to cause relative movement along the channels between the plurality of tilt baskets and corresponding ones of the plurality of elongated guide members to adjust a tilt angle of the number of slats between a full forward tilt with each of the plurality of tilt baskets abutting the first terminal end of the channel defined through a corresponding one of the plurality of guide members and a full rearward tilt with each of the plurality of tilt baskets abutting the second terminal end of the channel defined through a corresponding one of the plurality of tilt baskets.

BRIEF DESCRIPTION OF THE DRAWINGS

This disclosure is illustrated by way of example and not by way of limitation in the accompanying Figures. Where considered appropriate, reference labels have been repeated among the Figures to indicate corresponding or analogous elements.

DETAILED DESCRIPTION OF THE DRAWINGS

Figure 1:
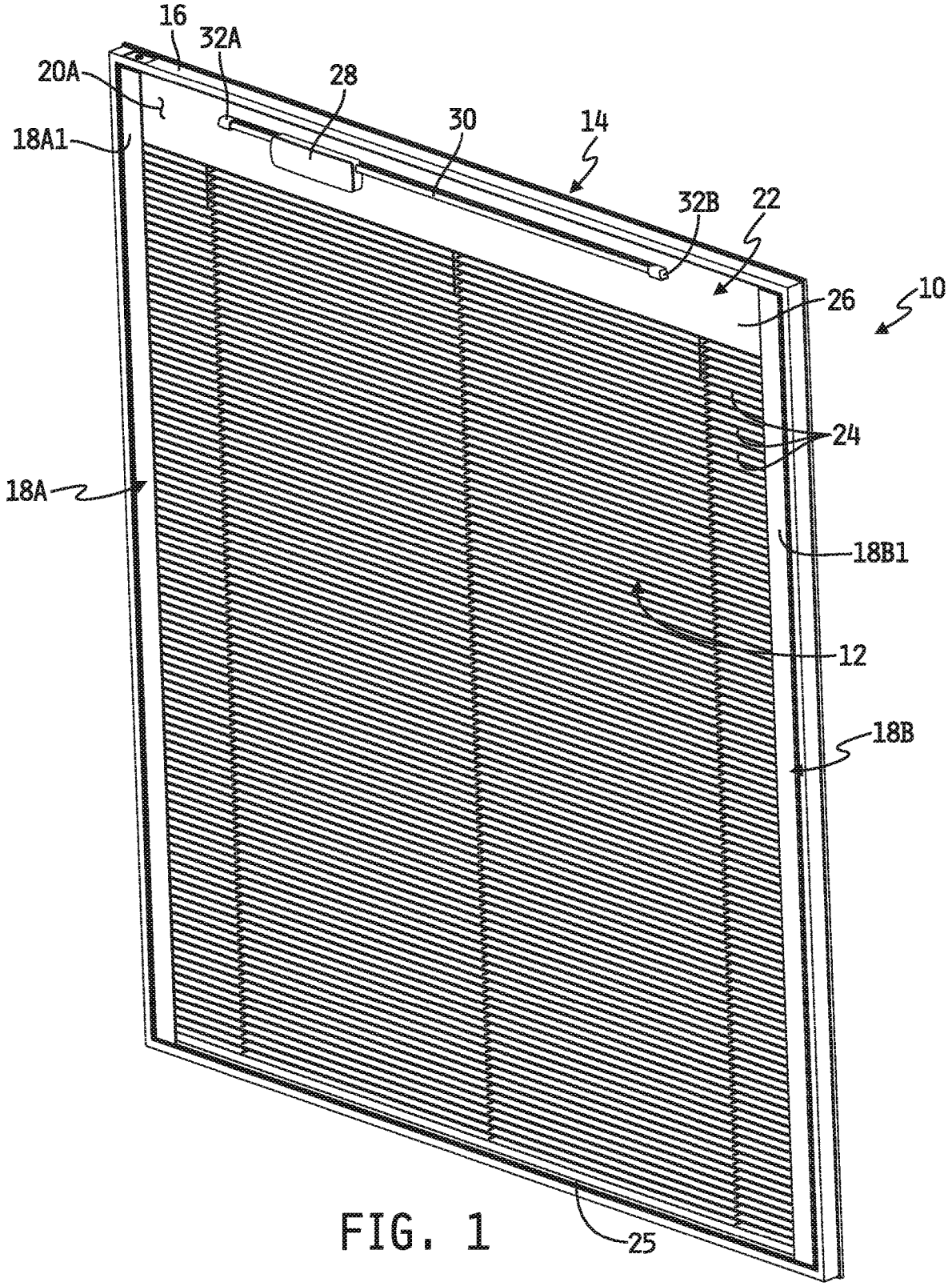
FIG. 1 is a front perspective view of an embodiment of an insulated glass (IG) unit including a blind assembly mounted and encapsulated therein.

While the concepts of the present disclosure are susceptible to various modifications and alternative forms, specific exemplary embodiments thereof have been shown by way of example in the drawing and will herein be described in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases may or may not necessarily refer to the same embodiment. Further, when a particular feature, structure or characteristic is described in connection with an embodiment, it is submitted that it is within the knowledge of one skilled in the art to effect such feature, structure or characteristic in connection with other embodiments whether or not explicitly described. Further still, it is contemplated that any single feature, structure or characteristic disclosed herein may be combined with any one or more other disclosed feature, structure or characteristic, whether or not explicitly described, and that no limitations on the types and/or number of such combinations should therefore be inferred.

Referring now to FIG. 1, a front perspective view is shown of an embodiment of a combination insulated glass (IG) unit and integral blind assembly 10 including a blind assembly 12 mounted and encapsulated within an IG unit 14. In the illustrated embodiment, the IG unit 14 illustratively includes a conventional frame or spacer 16 to and about which opposing and spaced-apart IG panels 20A and 20B are affixed or otherwise attached in a conventional manner. Conventional side curtains 18A, 18B, e.g., in the form of rigid, semi-rigid or flexible C-shaped or U-shaped channels or similar such structure, are affixed to the spacer 16 along opposite sides of thereof and illustratively extend from the top of the spacer 16 to the bottom of the spacer 16 along each side thereof. The side curtains 18A, 18B illustratively each include a front face 18A1, 18B1 respectively which extend along an operator side of the assembly 10, e.g., building interior, and an oppositely facing rear face 18A2, 1862 respectively. Only the front faces 18A1 and 18B1 shown in FIG. 1, it being understood that the rear faces 18A2, 18B2 are spaced apart from and identical to the respective front faces 18A1, 18B1.

The blind assembly 12 illustratively includes a control section 22 mounted to the spacer 16, a bottom rail 25 and a plurality of blind slats 24 suspended between the control section 22 and the bottom rail 25 in a conventional manner. The control section 22 illustratively includes a housing or panel 26 disposed over and/or about the control section 22 on each side of the IG unit 14 which covers and/or houses control components of the control section 22 and which extends from and along the top of the spacer 16 downwardly toward the slats 24. When the slats 24 are fully tilted forwardly or rearwardly, the top-most slat 24 illustratively contacts or is positioned proximate to and along the bottom of the housing 26. As illustrated by example in FIG. 1, the curtains 18A, 18B receive opposite ends of the slats 24 and the bottom rail 25 partially therein such that the slats 24 and bottom rail 25 all travel along the curtains 18A, 18B between the front and rear faces 18A1, 18A2 and 18B1, 18B2 thereof as the blind assembly 12 is raised and lowered. Together with the housing 26, the curtains 18A, 18B illustratively operate to block light and visibility over and around the slats 24 when fully tilted forwardly or rearwardly.

The blind assembly 12 illustratively includes an external actuator 28 movably mounted to an elongated, linear actuator rail 30 which extends between two spaced apart end posts 32A, 32B substantially parallel with the top of the spacer 16. In one embodiment, the end posts 32A, 32B are affixed to the external surface of the IG panel 20A and the actuator rail 30 is affixed at opposite ends to the end posts 32A, 32B. In some alternate embodiments, the actuator rail 30 may likewise be mounted to the external surface of the IG panel 20A. In any case, the external actuator 28 is manually movable along the actuator rail 30 between the end posts 32A, 32B to control raising/lower and tilting of the blind assembly 12.

In the embodiment illustrated in FIG. 1, the assembly 10 represents an upper or lower portion of a double-hung window oriented as shown. It will be understood, however, that the concepts described are not limited to double-hung windows, and that the blind assembly 12 may alternatively be mounted and encapsulated within other IG configurations. It will also be understood that any such IG configuration is not limited to any particular shape or dimension. In any such alternate embodiments, the actuator rail 30 may be non-linear and/or may be oriented differently relative to any of the edges of the spacer 16. In other alternative embodiments, the blind assembly 12 may not be mounted within and encapsulated by an IG unit as just described, but may instead be configured to mount to or near a top edge of a window opening in a building or door external to an IG or other window/panel mounted within such window opening.

Figure 2:
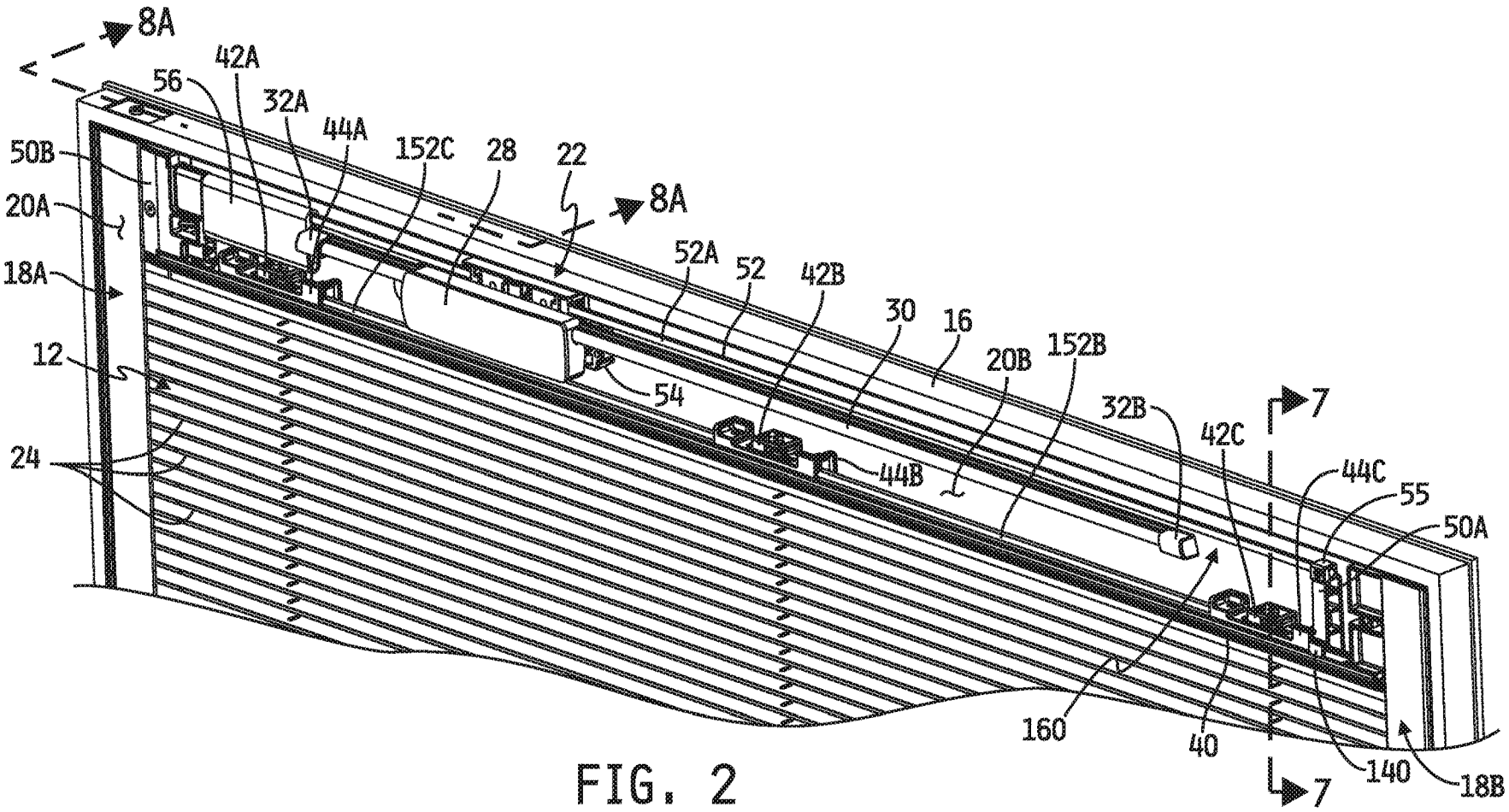
FIG. 2 is a perspective view of an upper portion of the IG unit of FIG. 1 with the housing of the control section of the blind assembly removed.
Figure 3:
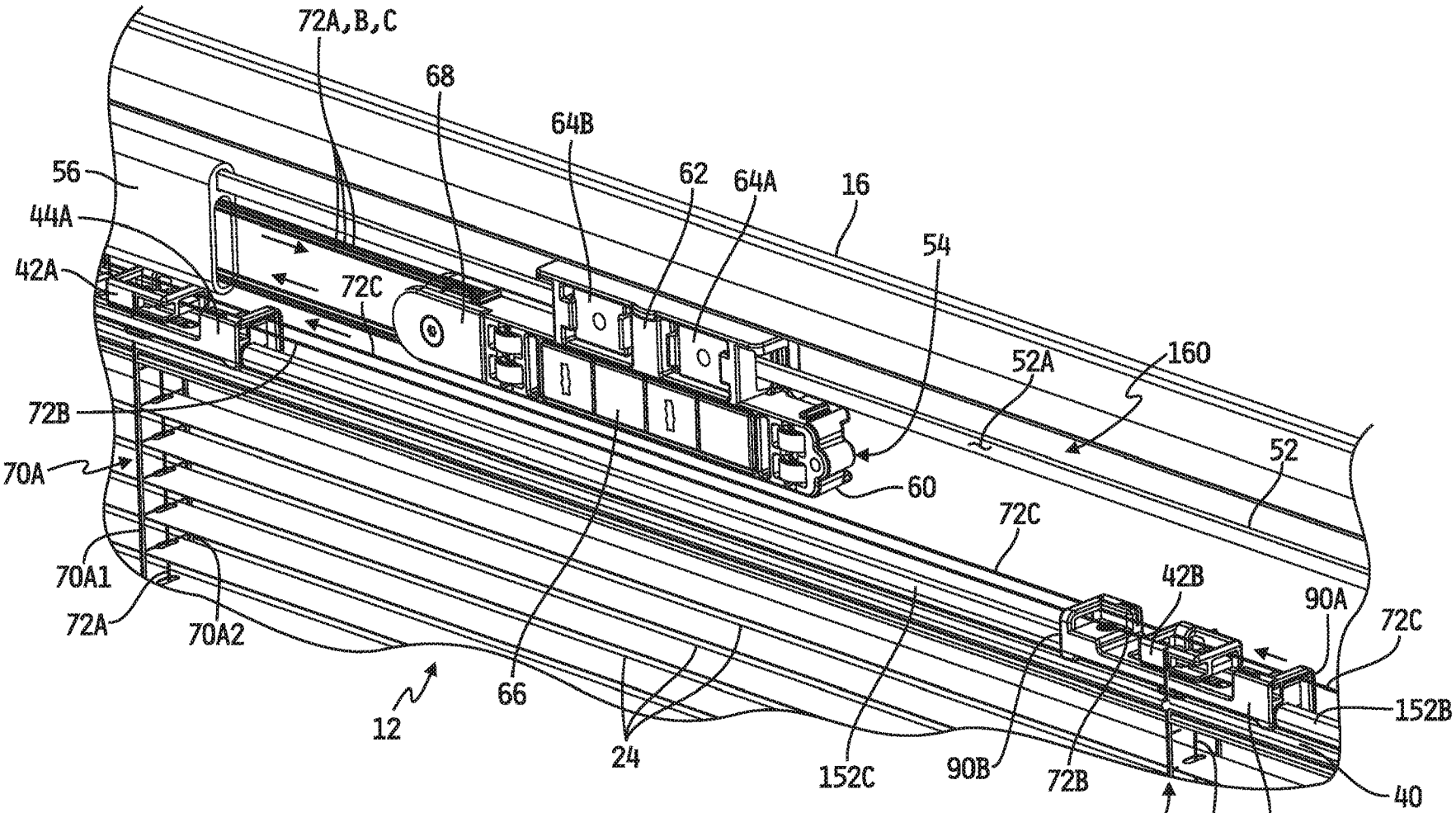
FIG. 3 is a perspective view similar to FIG. 2 with the external blind assembly actuator removed.

Referring now to FIGS. 2 and 3, the housing 26 has been removed to illustrate the various control components of the control section 22 of the blind assembly 12. It will be noted that FIG. 2 includes the external actuator 28, actuator rail 30 and end posts 32A, 32B described above, and that such components have been removed in FIG. 3 to illustrate features of an internal actuator 54. In any case, the control section 22 of the blind assembly 12 includes an elongated headrail 40 which extends between and is illustratively mounted to the sides of the spacer 16 in a conventional manner, and which is substantially parallel with and spaced apart from the top of the spacer 16. A plurality of elongated guide members are slidable along the top surface of the headrail 40, and each of the plurality of elongated guide members is movably coupled to a corresponding tilt basket secured to the headrail 40. In the illustrated embodiment, the blind assembly 12 includes three such elongated guide members 44A, 44B and 44C and associated tilt baskets 42A, 42B, 42C respectively spaced apart along the headrail 40, although it will be understood that other embodiments of the blind assembly 12 may include more or fewer such pairs of guide members and associated tilt baskets.

Adjacent ones of the guide members 44A, 44B, 44C are illustratively coupled together by elongated attachment rods extending therebetween. As illustrated most clearly in FIG. 2, for example, one end of an elongated guide rod 152B is coupled to one end of the guide member 44C and an opposite end of the guide rod 152B is coupled to one end of the guide member 44B. As further illustrated in FIG. 6A, a platform 115B adjacent one end 90B of the guide member 44C defines an opening 92B therethrough and an attachment member 144B engages the opening 92B and secures the guide rod 152B to the guide member 44C. Likewise, as illustrated in FIG. 6B, a platform 115A adjacent one end 90A of the guide member 44B defines an opening 92A therethrough and an attachment member, similar or identical to the attachment member 144B illustrated in FIG. 6A, passes into and engages the opening 92A to secure the guide rod 152B to the guide member 44B. In the example illustrated in FIG. 6B, the attachment member is omitted to show extension of the guide rod 152B into and through the end 90A of the guide member 42B so as to be positioned centrally under the platform 115A and therefore centered under and aligned with the opening 92A. In one embodiment, the attachment members 144B may be any conventional attachment members separate from the guide rod 152B and the guide members 44B, 44C. Alternatively, either or both of the attachment members 144B may be integral with the guide rod 152B or the respective guide member 44B, 44C, and in some such embodiments the attachment member and the respective guide rod 152B or the respective guide member 44B, 44C may be of unitary construction.

One end of another elongated guide rod 152C is coupled to one end of the guide member 44B and an opposite end of the guide rod 152C is coupled to one end of the guide member 44A. As further illustrated in FIG. 6B, a platform 115B adjacent the end 90B of the guide member 44B defines an opening 92B therethrough and an attachment member, e.g., similar or identical to the attachment member 144B, engages the opening 92B and secures the guide rod 152C to the guide member 44B. Likewise, a platform 115A adjacent one end 90A of the guide member 44A defines an opening 92A therethrough and an attachment member engages the opening 92A and secures the guide rod 152C to the guide member 44A identically as illustrated with the guide rod 152B and guide member 44B depicted in FIG. 6B. The three guide members 44A, 44B, 44C are thus serially interconnected via the guide rods 152B and 152C.

Figure 6A:
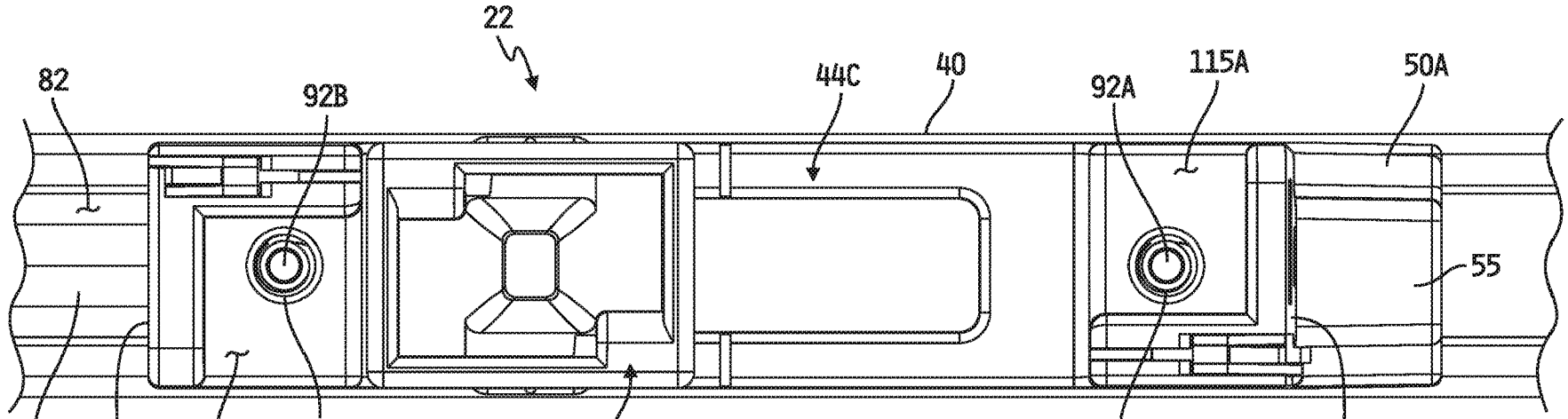
FIG. 6A is a top plan view of the right-most portion of the control section of the blind assembly as viewed in FIG. 2.
Figure 6B:
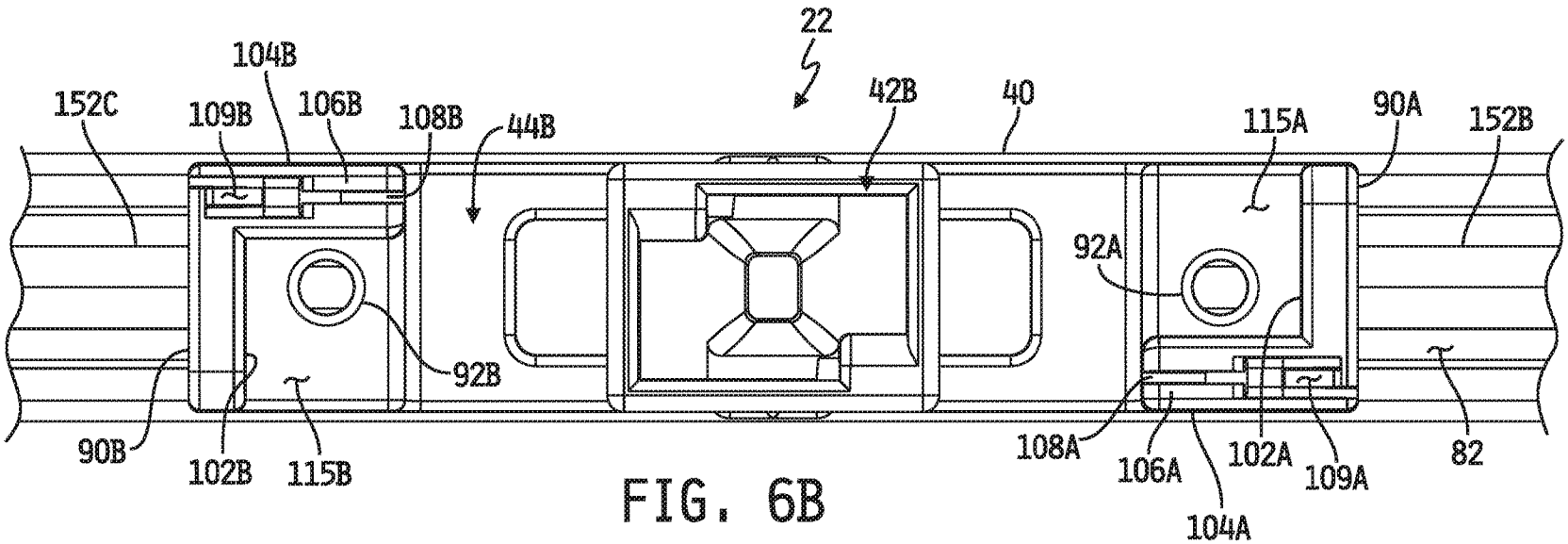
FIG. 6B is a top plan view of the center portion of the control section of the blind assembly as viewed in FIG. 2.

An end cap 140 is coupled to an opposite end of the guide member 44C, and a spacing member 50A is coupled to a top surface of the end cap 140 as best illustrated in FIGS. 2 and 6A. In one embodiment, the guide member 44C, spacing member 50A and end cap 140 are all rigidly secured to each other, although in alternate embodiments two or more of the guide member 44C, spacing member 140 and end cap 140 may be of unitary construction. In any case, the guide members 44A, 44B, 44C, guide rods 152B, 152C, spacing member 50A and end cap 140 are secured to each other such that the combination is axially movable as a unit along the top surface of the headrail 40.

Figure 8A:
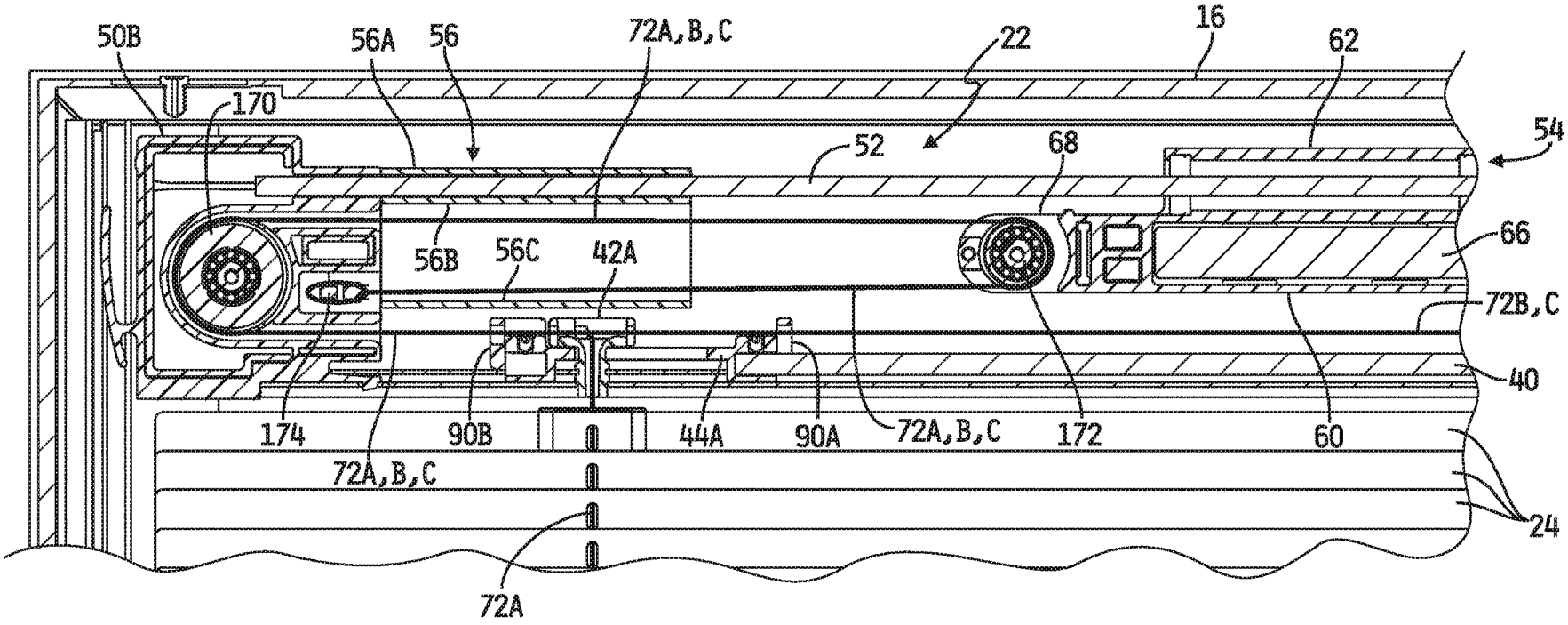
FIG. 8A is a cross-sectional view of a portion of the IG unit and blind assembly as viewed along section lines 8A-8A of FIG. 2.
Figure 8B:
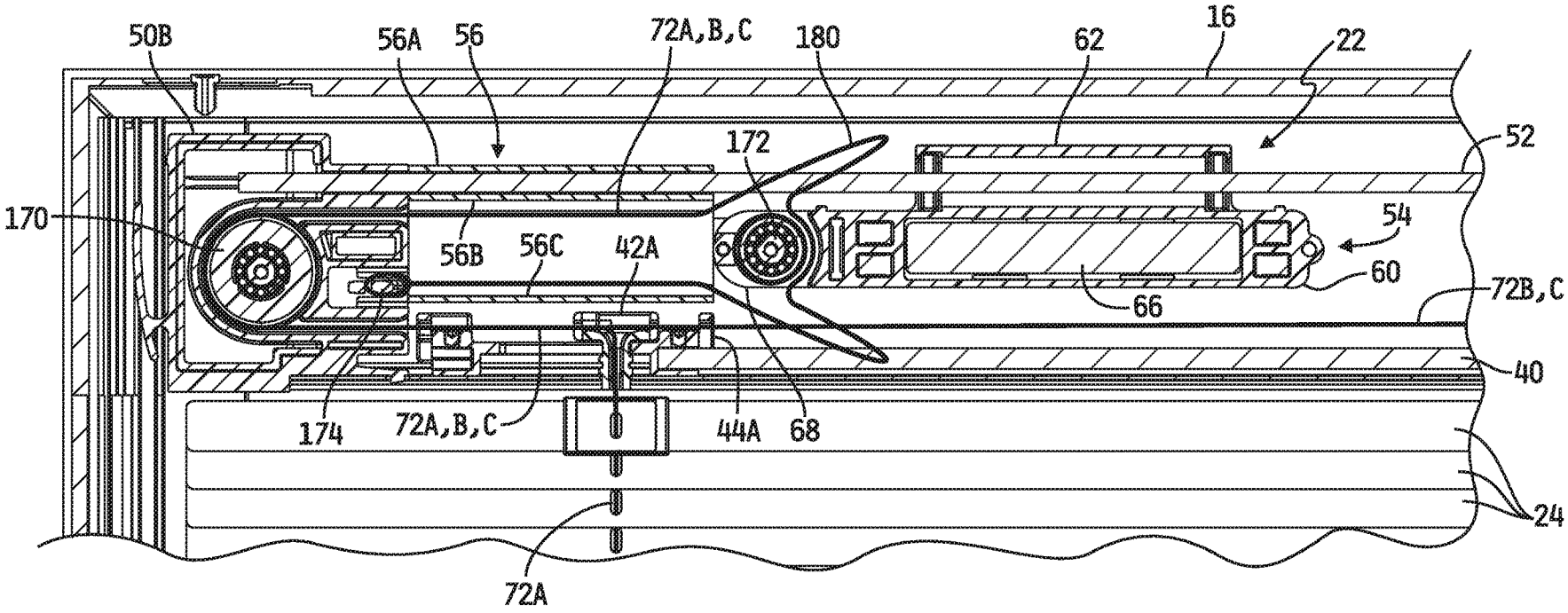
FIG. 8B is a cross-sectional view similar to FIG. 8A but showing a different state of the blind assembly with the actuator positioned against the spacer.

Referring again to FIG. 2, another spacing member 50B is positioned on top of the headrail 40 at a side of the spacer 16 opposite that at which the spacing member 50A is positioned. In some embodiments, the spacing member 50B may be affixed to the side of the spacer 16, and in other embodiments the spacing member 50B may be affixed to the top of the headrail 40 and/or to the side of the spacer 16. Another elongated guide rod 52 extends between opposite ends of the spacing members 50A, 50B such that the guide rod 52 is spaced apart from yet substantially parallel with the headrail 40 and the series of interconnected guide members 44A, 44B, 44C and guide rods 152B, 152C. As best illustrated in FIG. 2, one end of the elongated guide rod 52 is affixed to an end cap 55 coupled to the spacing member 50A such that the spacing member, and cap 55 and guide rod 52 are rigidly secured to each other. In alternate embodiments, the end cap 55 and the spacing member 55A may be of unitary construction. As best shown in FIGS. 8A and 8B, the top portion of the spacing member 50B illustratively has a channel formed therein which slidingly receives the opposite end of the guide rod 52 such that the guide rod 52 is axially movable along the channel relative to the actuator spacing member 50B. Because the spacing member 50A is secured to the guide rod 52 and to the guide member 44C at or adjacent to spaced-apart ends thereof, axial movement of the guide rod 52 relative to the spacing member 50B results in identical axial movement of the guide members 44A, 44B, 44C and guide rods 152B, 152C along the top surface of the headrail 40. The guide rod 52, spacer 50A, end cap 55, end cap 140, guide members 44A, 44B, 44C and guide rods 152B, 152C are thus all secured together and therefore move together. For purposes of the following description, the combination of such interconnected components will thus be referred to as a guide structure 160 as indicated in FIGS. 2 and 3, and axial movement of the guide rods 152B, 152C and interconnected guide members 44A, 44B, 44C along the top of the headrail 40 will be referred to as axial movement of the guide structure 160.

As best shown in FIG. 3, the internal actuator 54 includes a lower housing 60 coupled to or integral with an upper housing 62, wherein the upper housing 66 defines a channel longitudinally therethrough (see, e.g., FIGS. 8A and 8B). The guide rod 52 illustratively extends through the longitudinal channel defined through the upper housing 66 such that the upper and lower housings 66, 60 respectively, and thus the internal actuator 54, is axially movable along the guide rod 52. A spool housing 68 is coupled to or integral with one end of the lower housing 60, and a spacer 56 is positioned on the guide rod 52 adjacent to the spacing member 50B such that the spacer 56 is positioned between the spool housing 68 of the internal actuator 54 and the spacing member 50B.

Figure 7:
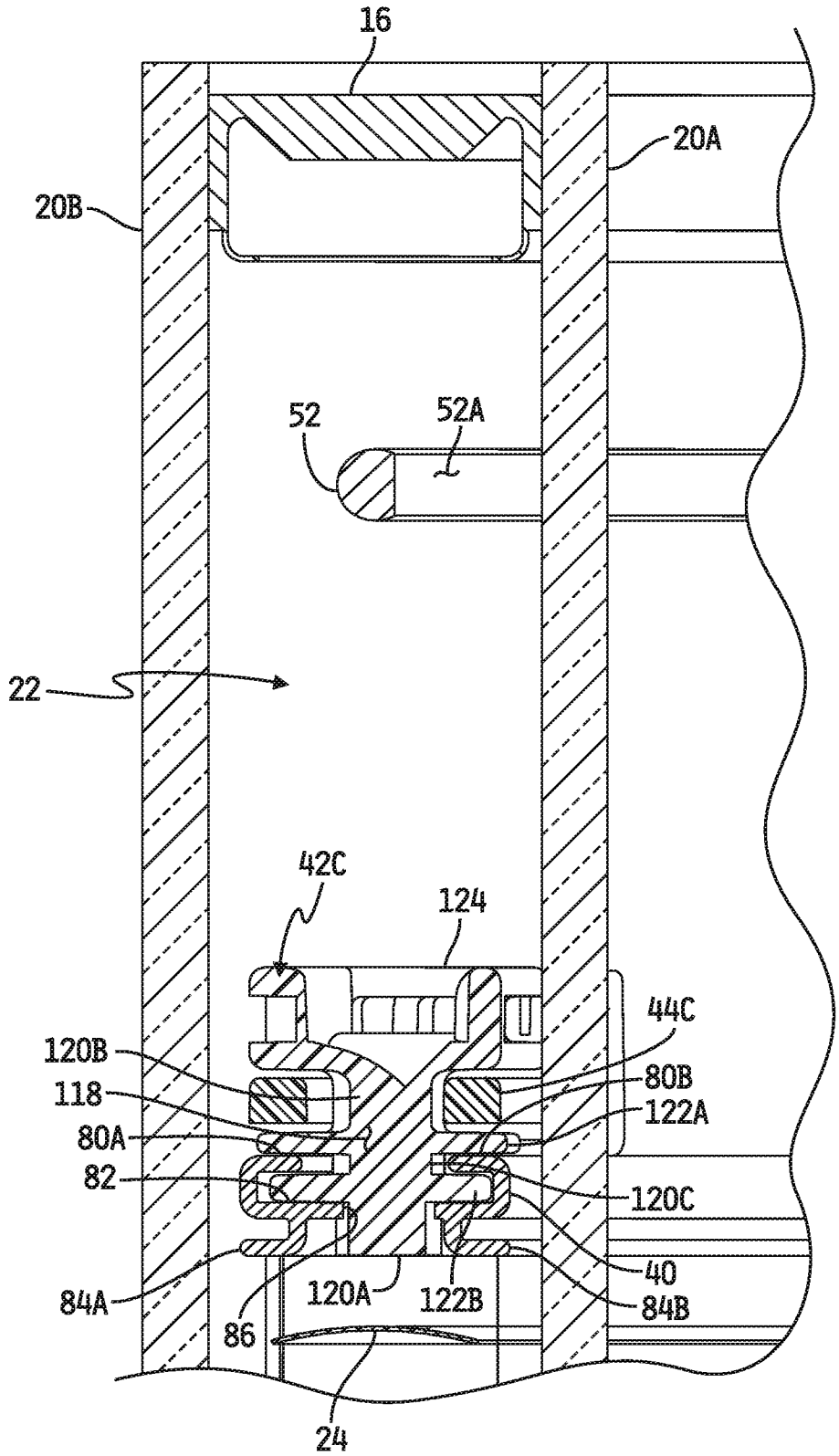
FIG. 7 is a perspective, cross-sectional view of the IG unit and blind assembly as viewed along section lines 7-7 of FIG. 2.

The internal actuator 54 further includes at least one magnet carried by the upper housing 66, and the guide rod 52 is illustratively formed of a magnetically attracting material such that the at least one magnet carried by the upper housing 66 contacts and adheres to the guide rod 52 via magnetic force. As best shown in FIG. 3, two magnets 64A, 64B are mounted to and within the upper housing 66, each magnetically adhering to the guide rod, although in alternate embodiments more or fewer such magnets may be mounted within the upper housing 66. As also illustrated in FIGS. 3 and 7, the guide rod 52 illustratively has a planar surface 52A facing the magnets 64A, 64B, and in the illustrated embodiment the magnets 64A, 64B have planar faces which magnetically engage the planar surface 52A of the guide rod 52. As will be described in further detail below, as long as the tilt baskets 42A, 42B, 42C do not impede axial movement of the guide structure 160, axial movement of the internal actuator 54 relative to the headrail 40 will cause identical axial movement of the guide structure 160 due to the magnetic coupling between the one or more magnets, e.g., 64A, 64B, and the guide rod 52.

The internal actuator 54 further includes at least one magnet carried by the lower housing 60. As best shown in FIG. 3, for example, a magnet or magnet assembly 66 is mounted to and within the lower housing 60, and a planar magnetic surface of the magnet or magnet assembly 66 faces outwardly toward the IG panel 20A. The external actuator 28 likewise includes yet another magnet or magnet assembly which faces inwardly (not shown) and which magnetically couples to the magnet or magnet assembly 66 when the external actuator 28 is mounted to the actuator rail 30 and aligned with the internal actuator 54 as illustrated in FIG. 2. Via magnetic coupling between the magnet or magnet assembly 66 of the internal actuator 54 and the magnet or magnet assembly of the external actuator 28, manual movement of the external actuator 28 axially along the actuator rail 30 causes the internal actuator 54 to move axially along the guide rod 52.

Referring now to FIGS. 4A-5B, the structure and operation of an embodiment of one of the elongated guide members 44B and associated tilt basket 42B will be described in detail. It will be understood that the structure and operation of the remaining guide members 44A, 44C and associated tilt baskets 42A, 42C will be as described with respect to the guide member 44B and tilt basket 42B. In the illustrated embodiment, the elongated guide member 44B is, as briefly described above, configured to move axially along the top of the headrail 40 while the tilt basket 42B is configured to be secured to the headrail 40, as shown by example in FIGS. 4B and 4C. The headrail 40 is illustratively an elongated rail having a planar top surface defining an elongated channel 82 between two inwardly curved and opposing flanges 80A, 80B at opposite sides thereof, all of which illustratively extend along the length of the headrail 40. In the illustrated embodiment, the elongated guide rail 44B has four feet extending downwardly from a bottom surface thereof; one at or adjacent to each of the four corners thereof. Two such feet 91A, 91B are illustrated by example 4C and, as also illustrated in FIG. 4C, each of the feet, e.g., 91A, 91B, is aligned with a top surface of the flange 80A so as to ride along the top surface of the front flange 80A. The two remaining feet are identical to the illustrated feet 91A, 91B and similarly align with the top surface of the flange 80B so as to ride along the top surface thereof.

In some embodiments, as illustrated by example in FIG. 7, a bottom planar surface of the headrail 40 defines outwardly curved and opposing flanges 84A, 84B at and longitudinally along opposite sides thereof which extend along the length of the headrail 40. In some such embodiments, channels formed by each the curved flanges 84A, 84B may be used to secure the housing or panel 26 to the headrail 40 and/or to secure the opposite ends of the headrail 40 to the spacer 16 and/or to portions of the side curtains 18A1, 18A2 between the vertically extending sidewalls thereof.

Figure 4A:
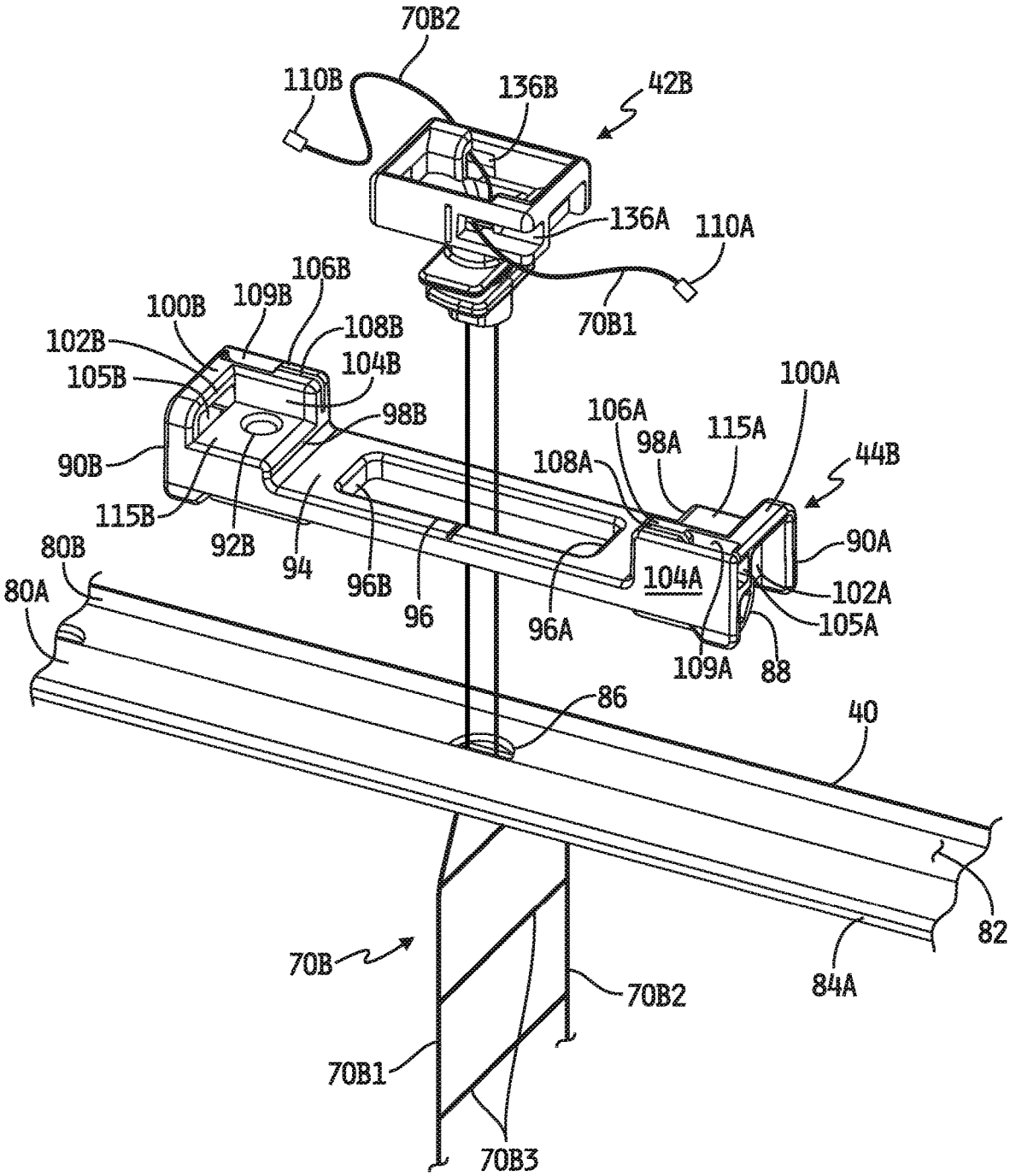
FIG. 4A is a perspective exploded view of an embodiment of at least a portion of a blind tilt adjustment assembly implemented in the blind assembly illustrated in FIGS. 1-3.
Figure 4B:
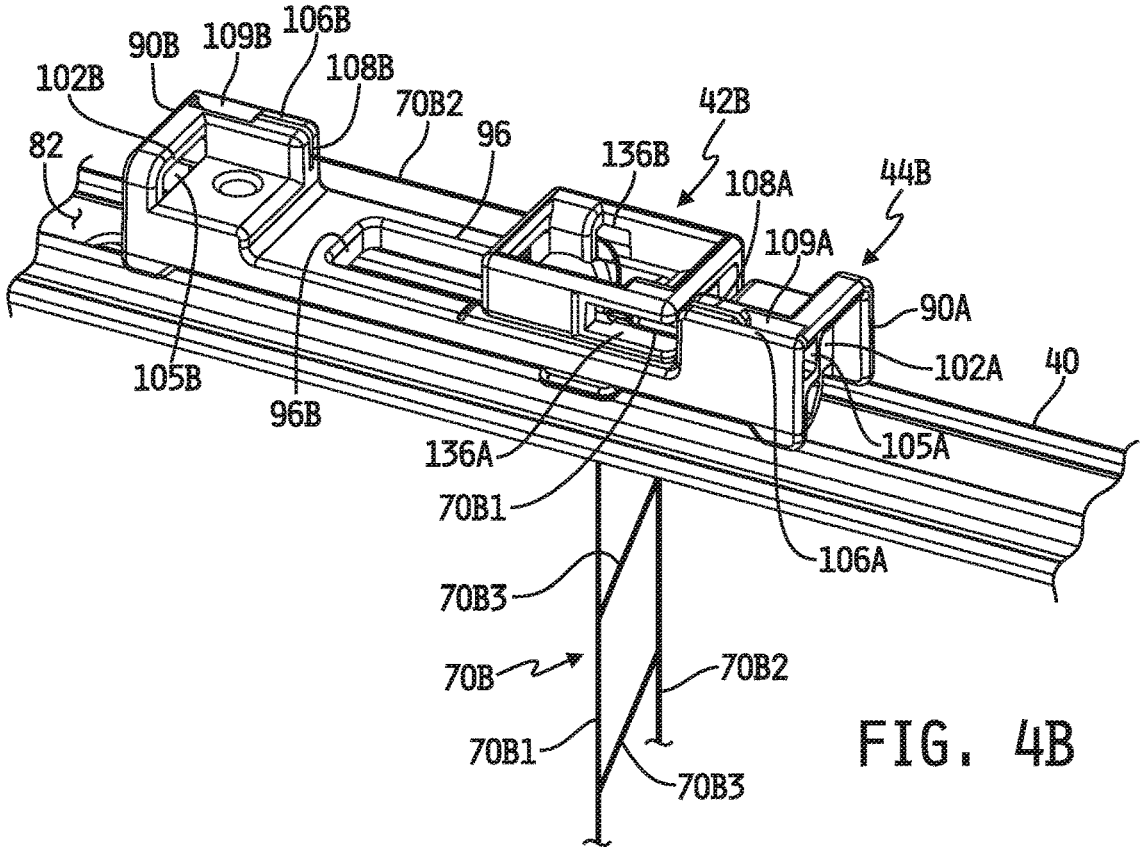
FIG. 4B is a perspective view similar to FIG. 4A illustrating the position of the blind tilt adjustment assembly with the blind slats fully tilted forwardly.
Figure 4C:
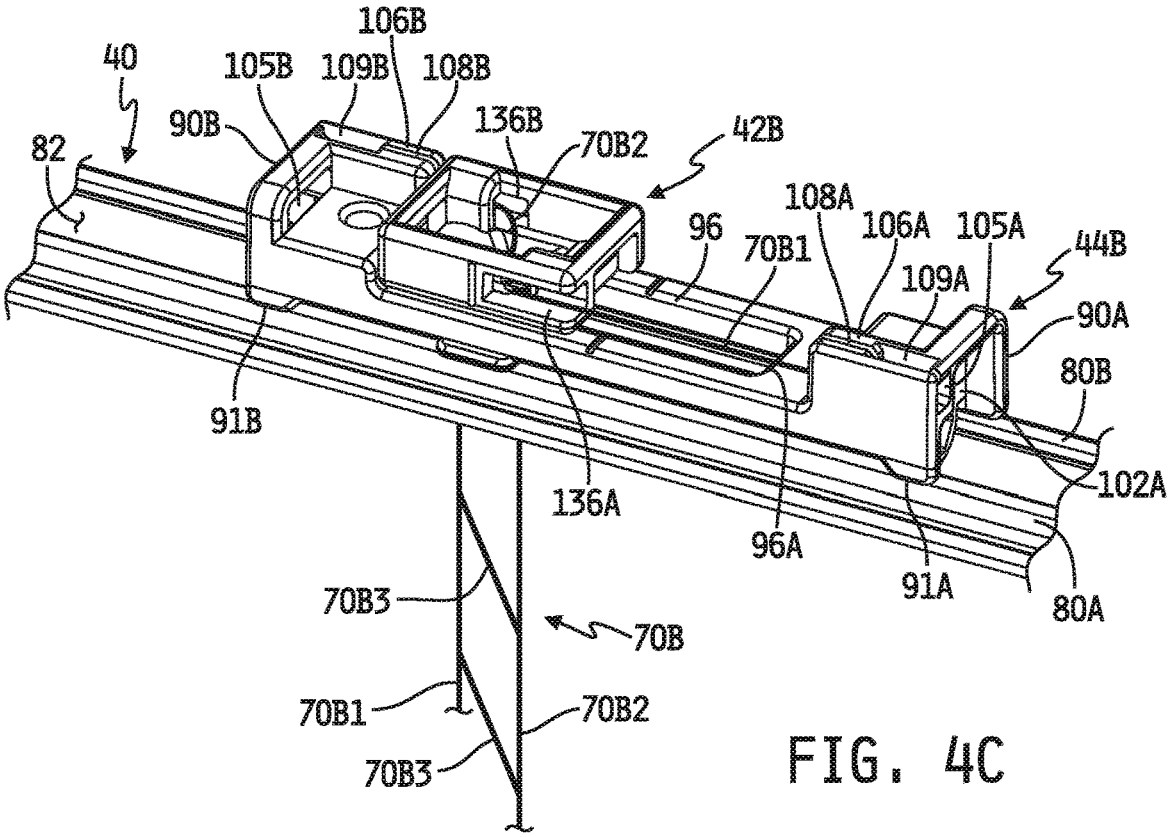
FIG. 4C is a perspective view similar to FIGS. 4A and 4B illustrating the position of the blind tilt adjustment assembly with the blind slats fully tilted rearwardly.

In the illustrated embodiment, the guide member 44B is an elongated structure having an elongated, planar body portion 94 positioned between substantially planar platforms 115A, 115B at opposite ends 90A, 90B thereof. The elongated guide member 44B is positioned relative to the headrail 40 such that the longitudinal or axial direction of the elongated guide member 44B is substantially parallel with the longitudinal or axial direction of the headrail 40. In the example illustrated in FIGS. 4A-4C, the planar body portions 94 and the planar platforms 115A, 115B are of unitary construction, although in alternate embodiments they may be separate pieces joined together in a conventional manner. In any case, the ends 90A, 90B of the guide member 44B define bores 88 which extend into the guide member 44B in a direction substantially parallel with longitudinal or axial direction of the guide member 44B, and the platforms 115A, 115B define bores 92A, 92B respectively therein, each of which extend in a direction substantially normal to, and intersect, the bores 88. Although only the bore 88 extending into the end 90A of the guide member 44B is shown in FIGS. 4A-4C, it will be understood that the end 90B defines an identical bore 88 therein. As described above with respect to FIGS. 2, 3, 6A and 6B, the bores 88 are illustratively sized to receive one of the elongated guide rods 152B, 152C therein, and the bores 92A, 92B are sized to receive one of the attachment members 144B therein to secure corresponding opposing pairs of the elongated guide rods 152B, 152C to the guide member 44B.

Each of the substantially planar platforms 115A, 115B of the guide member 44B illustrated in FIGS. 4A-4C is flanked at and along a corresponding end 90A, 90B of the guide member 44B by a substantially normal wall 102A, 102B which extends upwardly from the respective platform 115A, 155B and terminates at a wall top 100A, 100B (see also FIG. 6B). The wall 102A illustratively defines an opening 105A therethrough, and the wall 102B likewise defines an opening 150B therethrough. The substantially planar platform 115A is further flanked at and along a front edge thereof by another substantially normal wall 104A which extends upwardly from the platform 115A and terminates at a wall top 106A, and the substantially planar platform 115B is further flanked at and along a rear edge thereof by yet another substantially normal wall 104B which extends upwardly from the platform 155B and terminates at a wall top 106B (see also FIG. 6B). Each wall 104A, 104B is illustratively coupled to a corresponding one of the walls 102A, 102B such that the wall pairs 102A, 104A and 102B, 104B extend partially about and partially enclose a periphery of the corresponding platform 115A, 115B. In the example illustrated in FIGS. 4A-4C, the walls 102A, 104A, 102B, 104B and the planar body portions 94 and planar platforms 115A, 115B are all of unitary construction, although in alternate embodiments they may be separate pieces joined together in a conventional manner.

As illustrated most clearly in FIG. 6B, the wall top 106A of the front wall 104A illustratively defines a longitudinal slot 108A therein which extends from a free end of the wall 104A to a channel 109A formed in the wall top 106A adjacent to the end wall 102A. The slot 108A illustratively extends into the front wall 104A and extends along the front wall 104A between the channel 109A and the free end of the wall 104A such that the slot 108A is open at the free end of the wall 104A at one end thereof and is open to the channel 109A an opposite end thereof. Likewise, the top wall 106B of the rear wall 104B illustratively defines a slot 108B therein and a channel 109B therein adjacent to the end wall 102B. The slot 108B illustratively extends into the rear wall 104B and extends along the rear wall 104B between the channel 109B and the free end of the wall 104B such that the slot 108B is open at the free end of the wall 104B at one end thereof and is open to the channel 109B an opposite end thereof. The slots 108A, 108B and channels 109A, 109B are illustratively sized and configured to engage blind tilt cords as will be described in detail below.

As further illustrated in FIG. 4A, the top surface of the planar body portion 94 of the elongated guide member 44B is substantially flat and defines a step 98A at one end between the body portion 94 and the top surface of the platform 115A positioned above the top surface of the body portion 94, and another step 98B at an opposite end between the body portion 94 and the top surface of the platform 115B positioned above the top surface of the body portion 94. Between the steps 98A, 98B, the body portion 94 illustratively defines a channel 96 therethrough which extends generally parallel to the longitudinal or axial directions of the elongated guide member 44B and the headrail 40. The channel 96 illustratively terminates at one end 96A near the step 98A and at an opposite end 96B near the step 98B.

Figure 5A:
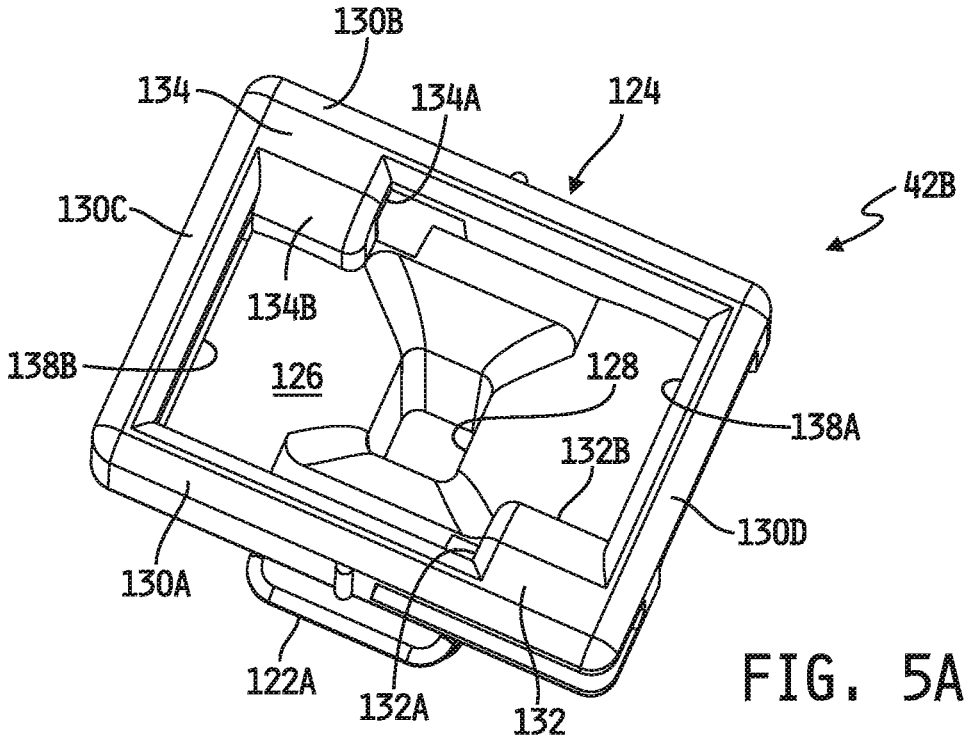
FIG. 5A is a top perspective view of the tilt basket illustrated in FIGS. 4A-4C.
Figure 5B:
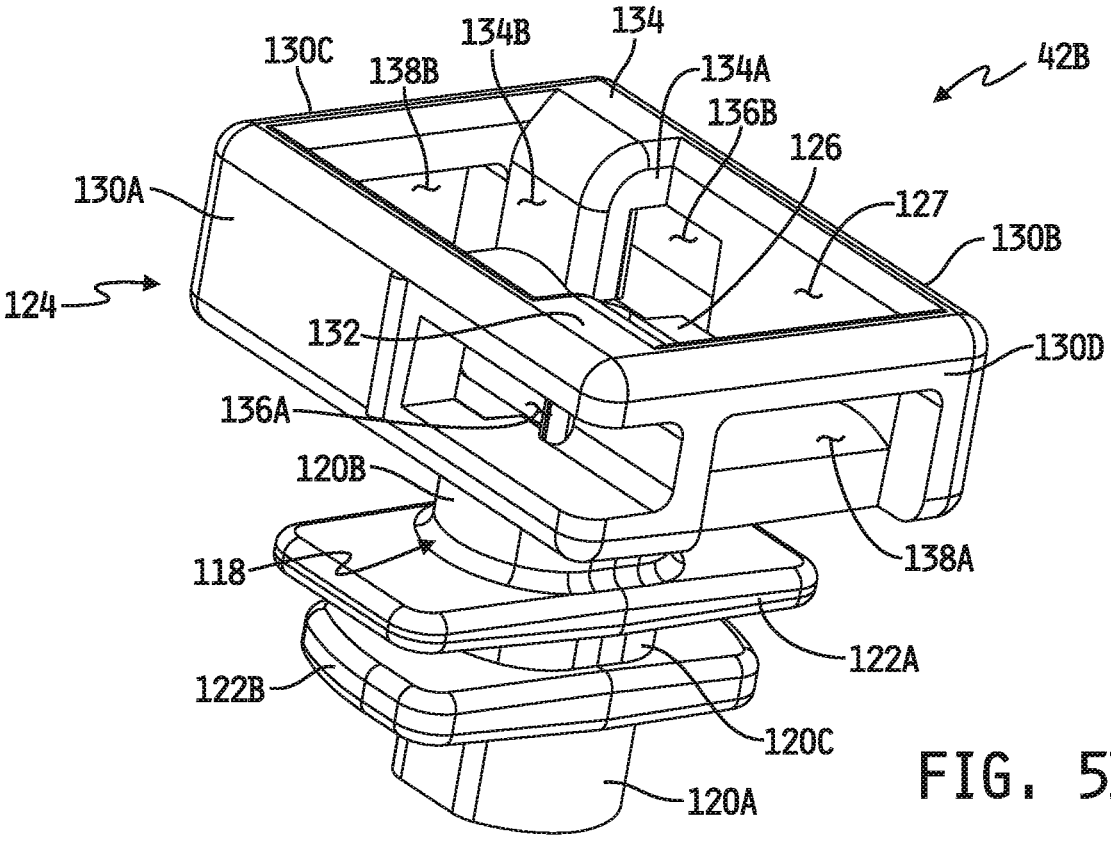
FIG. 5B is a side perspective view of the tilt basket illustrated in FIGS. 4A-5A.

Referring now to FIGS. 4A-4C and 5A-5B, an embodiment of the tilt basket 42B is shown. As briefly described above, the tilt basket 42B is configured to be secured to the headrail 40, and in this regard the headrail 40 illustratively defines an opening 86 therethrough as depicted most clearly in FIG. 4A. As best shown in FIG. 5B, the tilt basket 42B illustratively includes a shaft 118 mounted to a basket 124 with spaced-apart locking members 122A, 122B surrounding the shaft 118 to define a portion 120A of the shaft 118 (hereinafter referred to as a post 120A) extending downwardly and away from the locking member 122B and sized to be received within the opening 86 defined through the headrail 40. Another portion 120B of the shaft 118 (hereinafter referred to as a stem 120B) extends between the locking member 122A and the basket 124, and yet another portion 120C of the shaft 118 extends between the spaced-apart locking members 122A, 122B.

In the illustrated embodiment, the locking members 122A and 122B are planar and generally rectangular structures each with opposing long edges defining a width therebetween, opposing short edges defining a length therebetween and rounded corners at the interfaces of the long and short edges. The planar locking member 122B further illustratively has a thickness sized to be received within the channel 82 of the headrail 40 and also within the opposing gaps defined by and between the inwardly curved flanges 80A, 80B as best illustrated in FIG. 7. The width of the planar locking member 122B is illustratively sized to be received through the channel 96 defined through the elongated guide member 44B as illustrated in FIGS. 4A-4C, and to be received within the channel 82 of the headrail 40, i.e., between the opposing faces of the inwardly curved flanges 80A, 80B. The length of the planar locking member 122B is illustratively sized to be received within the opposing gaps defined by and between the inwardly curved flanges 80A, 80B of the headrail 40 as shown in FIG. 7. The width of the planar locking member 122A is illustratively sized to be received through the channel 96 defined through the elongated guide member 44B as illustrated in FIGS. 4A-4C, and but not within the channel 82 of the headrail 40, i.e., between the opposing faces of the inwardly curved flanges 80A, 80B.

Mounting of the tilt basket 42B and elongated guide member 44B to the headrail 40 will now be described in detail, and it will be understood that the combination of the tilt basket 42A and guide member 44A and the combination of the tilt basket 42C and guide member 44C will be mounted to the headrail 40 in the same manner. With the elongated guide member 44B positioned over the top surface 82 of the headrail 40 such that the channel 96 defined therethrough is positioned over the bore 86 defined through the headrail 40 as illustrated in FIG. 4A, the tilt basket 42B is oriented such that the long sides of the planar locking members 122A, 122B are parallel with the opposing long sides of the channel 96. The planar locking members 122A, 122B are then passed through the channel 96 and into the channel 82 such that the post 120A is received within the bore 86. The tilt basket 42B is then rotated 90 degrees either clockwise or counterclockwise so that the short sides of the planar locking member 122B become parallel with the long sides of the channel 96 and so that the length of the planar locking member 122B is received within the opposing gaps defined by and between the inwardly curved flanges 80A, 80B of the headrail 40 so as to engage the headrail 40 beneath the channel 96 of the elongated guide member 44B as illustrated by example in FIG. 7. The length of the bottom surface of the locking member 122A rides on and along the top surfaces of the inwardly curved flanges 80A, 80B, as also illustrated in FIG. 7.

The tilt basket 42B is thus prevented from moving longitudinally or axially along the headrail 40 by the post 120A extending through the bore 86, and is further prevented from moving in a direction normal to the top surface of the headrail 40 via engagement of the planar locking member 122B with and within the channel 82 defined by the top surface of the headrail 40 and the opposing gaps defined by the inwardly curved flanges 80A, 80B. The tilt basked 42B is thus secured to the headrail 40, and the elongated guide member 44B is trapped between the locking member 122 and the basket 124 such that the channel 96 of the elongated guide member 44B is movable relative to the stationary stem 120B of the tilt basket 124B and the headrail 40 in the longitudinal or axial direction of the headrail 40. More specifically, the elongated guide member 44B is movable along the channel 96 relative to the tilt basket 42B in the longitudinal or axial direction of the headrail 40 between a rightmost extreme position at which the stem 120B of the shaft 118 contacts the end 96A of the channel 96 such that the tilt basket 42B is prevented from further movement in this direction as illustrated by example in FIG. 4B, and a left most extreme position at which the stem 120B of the shaft 118 contacts the opposite end 96B of the channel 96 such that the tilt basket 42B is prevented from further movement in this direction as illustrated by example in FIG. 4C.

Referring now specifically to FIGS. 5A and 5B, the basket 124 of the tilt basket 42B is illustratively provided in the form of a substantially rectangular container having a bottom wall 126 positioned over the stem 120B of the shaft 118 with four joined sidewalls 130A-130D extending upwardly from and surrounding the periphery of the bottom wall 126. The shaft 118 and the basket 124 of the tilt basket 42B together define a bore 128 centrally therethrough which, when the tilt basket 42B is secured to the headrail 40 and movably coupled to the elongated guide member 44B as described above, extends in a direction generally normal to the longitudinal or axial direction of the channel 96 and the headrail 40. The bottom wall 126 and the sidewalls 130A-130D illustratively together define a pocket 127 therebetween as shown.

A generally rectangular protrusion 132 extends inwardly into the pocket 127 from the front and side walls 130A, 130D respectively adjacent to the corner junction thereof, and another generally rectangular protrusion 134 extends inwardly into the pocket 127 from the rear and side walls 130B, 130C respectively adjacent to the corner junction thereof. The protrusion 132 defines a side wall 132A generally opposite to and facing an inner surface of the side wall 130C of the basket 124, and a rear wall 132B generally opposite to and facing an inner surface of the rear wall 130B of the basket 124. The protrusion 134 similarly defines a side wall 134A generally opposite to and facing an inner surface of the side wall 130D of the basket 124, and a front wall 134B generally opposite to and facing an inner surface of the front wall 130A of the basket 124. The side wall 132A of the protrusion illustratively defines a passageway 136A therethrough that opens to the exterior surfaces of the front and side walls 130A, 130D respectively of the basket 124, and the side wall 134A similarly defines a passageway 136B therethrough that opens to the exterior surfaces of the rear and side walls 130B, 130C respectively of the basket 124. The side wall 130D further defines another passageway 138A centrally therethrough, and the side wall 130C likewise defines another passageway 138B centrally therethrough.

Referring again specifically to FIGS. 4A-4C, the tilt basket 42B and associated elongated guide member 44B are operatively coupled to a conventional tilt ladder 70B including a front tilt cord 70B1, a rear tilt cord 70B2 and a plurality of spaced apart cross cords 70B3 interconnecting the front and rear tilt cords 70B1, 70B2 along their lengths between the headrail 40 and the bottom rail 25. In one embodiment, a cross cord 70B3 is interconnected between the front and rear tilt cords 70B1, 70B2 between each adjacent pair of blind slats 24 and adjacent to the underside of the topmost one of the adjacent pair of blind slats 24, although other embodiments may include more or fewer cross cords 70B3. As most clearly shown in FIG. 4A, the top end of the front tilt cord 70B1 is passed successively through the bore 86 defined through the headrail 40, the bore 128 defined through the tilt basket 42B and the passageway 136A defined through the basket 124. As also illustrated in FIG. 4A, a mounting clip 110A is affixed to the front tilt cord 70B1 at or near the top end thereof. The mounting clip 110A is illustratively sized and configured to be received within the channel 109A, and the slot 108A is illustratively sized to receive therein the front tilt cord 70B1 adjacent to the mounting clip 110A (see also FIG. 6B) such that the mounting clip 110A (and the top end of the front tilt cord 70B1) passes through the bore 128 of the tilt basket 42B, then through the opening 136A and is secured to and within the wall 104A of the elongated guide member 44B via the slot 108A and channel 109A. Likewise, a mounting clip 110B is affixed to the rear tilt cord 70B2 at or near the top end thereof. The mounting clip 110B is illustratively sized and configured to be received within the channel 109B and the slot 108B is illustratively sized to receive therein the rear tilt cord 70B2 adjacent to the mounting clip 110B (see also FIG. 6B) such that the mounting clip 110B (and the top end of the rear tilt cord 70B2) passes through the bore 128 of the tilt basket 42B, then through the opening 136B and is secured to and within the wall 104B of the elongated guide member 44B via the slot 108B and channel 109B.

In the illustrated embodiment, the lengths of the front and rear tilt cords 70B1, 70B2 are sized such that the blind slats 24 are substantially horizontal when the elongated guide member 44B is positioned relative to the headrail 40 and the stationary tilt basket 42B secured thereto with the tilt basket 42B positioned substantially centrally within the channel 96 of the guide member 44B, i.e., substantially equidistant from the two opposing ends 96A, 96B of the channel 96. This position of the elongated guide member 44B is illustrated by example in FIG. 4A in which the resulting substantially horizontal positioning of the blind slats 24 is represented by the substantially horizontal cross cords 7063 extending between the front and rear tilt cords 70B1, 70B2, and this position of the elongated guide member 44B and of the blind slats 24 will be referred to herein as the "fully open position."

As the elongated guide member 44B is moved from the fully open position illustrated in FIG. 4A to the left such that the end 96A of the channel 96 moves closer to the stem 120B of the tilt basket 42B, the effective length of the front tilt cord 70B1 increases and the effective length of the rear tilt cord 70B2 decreases such that the blind slats 24 tilt forwardly. Such leftward movement of the elongated guide member 44B ceases when the end 96A of the channel 96 makes contact with the stem 120B of the shaft 118 of the tilt basket 42B, in which case the front tilt cord 70B1 is at its maximum length and the rear tilt cord 70B2 is at its minimum length and the blind slats 24 are fully tilted forwardly. This position of the elongated guide member 42B and of the blind slats 24 is illustrated in FIG. 4B and will be referred to herein as the "fully tilted forward" position.

As the elongated guide member 44B is moved from the fully tilted forward position illustrated in FIG. 4B to the right such that the end 96B of the channel 96 moves closer to the stem 120B of the tilt basket 42B, the effective length of the front tilt cord 70B1 decreases and the effective length of the rear tilt cord 70B2 increases such that the blind slats 24 tilt away from the fully tilted forward position toward the fully open position. As the elongated guide member 44B continues rightward movement and passes the fully open position illustrated in FIG. 4A, the blind slats 24 begin to tilt rearwardly. Such rightward movement of the elongated guide member 44B ceases when the end 96B of the channel 96 makes contact with the stem 120B of the shaft 118 of the tilt basket 42B, in which case the front tilt cord 70B1 is at its minimum length and the rear tilt cord 70B2 is at its maximum length and the blind slats 24 are fully tilted rearwardly. This position of the elongated guide member 42B and of the blind slats 24 is illustrated in FIG. 4C and will be referred to herein as the "fully tilted rearward" position. It will be understood that each of the remaining tilt basket and elongated guide member pairs 42A, 44A and 42C, 44C are connected to corresponding front and rear tilt cords and operate as just described.

In the embodiment illustrated in FIGS. 1-6B, the guide structure 160, comprising the guide rod 52, spacer 50A, end cap 55, end cap 140, guide members 44A, 44B, 44C and guide rods 152B, 152C, is movable in the longitudinal or axial direction of the headrail 40 via corresponding longitudinal or axial movement of the internal actuator 54 as long the tilt baskets 42A, 42B, 42C do not impede such axial movement of the respective guide members 44A, 44B, 44C as described above with respect to FIGS. 4A-4C. In some alternative embodiments of the guide structure 160, the roles of the tilt baskets 42A-42C and the guide members 44A-44C may illustratively be reversed; that is, the elongated guide members 44A-44C may be affixed to the headrail 40 and the tilt baskets may form part of the guide structure 160 that is movable relative to the fixed guide members 44A-44C. An example embodiment of one such alternative guide structure 160' is illustrated in FIG. 6C in which an alternative tilt basket 42B' and an alternative elongated guide member 44B' are shown.

Figure 6C:
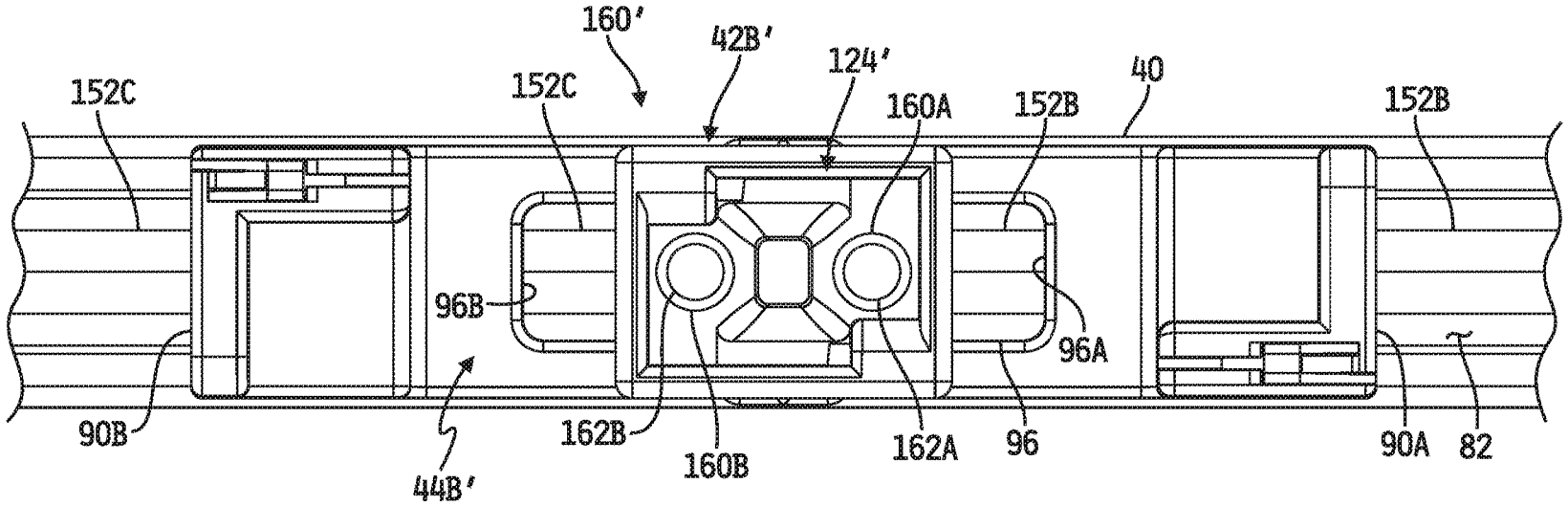
FIG. 6C is a top plan view similar to FIG. 6B and illustrating an alternate embodiment of the blind assembly.

In the embodiment illustrated in FIG. 6C, the elongated guide member 44B' is illustratively affixed to the headrail 40, e.g., via one or more posts, shafts or similar structures extending downwardly from a bottom surface of the guide member 44B' and into/through one or more correspondingly configured openings defined through the headrail 40. Illustratively, the one or more such posts, shafts or other such structures extending downwardly from the guide member 44B', as well as the one or more correspondingly configured openings defined through the headrail 40, are positioned so as not to impede axial movement of the guide rails 152B, 152C along and relative to the headrail 40. The tilt basket 42B', in the embodiment illustrated in FIG. 6C, is not affixed to the headrail 40 as is the tilt basket 42B illustrated in FIGS. 4A-4C, but is instead movable along and relative to the channel 96 defined through the elongated guide member 42B'. In the embodiment illustrated in FIG. 6C, the post 120A is illustratively omitted such that the shaft 118 of the tilt basket 42B' terminates at the locking member 122B. The basket 124' of the tilt basket 42B' is illustratively configured to receive ends of the guide rods 152B, 152C therein, and further illustratively defines openings 160A, 160B therethrough sized to receive attachment members 162A, 162B respectively therein for affixing the tilt basket 42B' to the guide rods 152B, 152C. The tilt basket 42*b*' may otherwise be coupled to the guide member 44B similarly as described above. In this alternate embodiment, axial movement of the guide rails 152B, 152C illustratively causes the tilt basket 42B' to move axially along the channel 96 between the two opposing ends 96A, 96B thereof.

Each of the guide member and tilt basket combinations is configured to pass therethrough a conventional raise/lower cord, and to feed all such feed/lower cords to and through the internal actuator 54 for control thereof. As illustrated in FIG. 3, for example, a raise/lower cord 72B passes upwardly (from the bottom rail 25 to which it is attached) through each of the plurality of blind slats 24, and then upwardly through the bore 128 defined through the tilt basket 42B. The raise/lower cord 72B then passes through the opening 138B in the leftmost end of the tilt basket 42B (see also FIG. 5B), and then passes through the opening 1056 in the leftmost end of the guide member 42B. Similarly, a raise/lower cord 72C associated with the tilt basket 42C and guide member 44C (not shown in FIG. 3) passes upwardly through the bore 128 in the tilt basket 42C, and then passes through the opening 138B in the leftmost end of the tilt basket 42C and then through the opening 105B in the leftmost end of the guide member 44C.

As further illustrated in FIG. 3, the raise/lower cord 72C then further passes through the opening 105A in the rightmost end of the guide member 44B and then through the opening 138A in the rightmost end of the tilt basket 42B, and then together with the raise/lower cord 72B the raise/lower cord 72C then passes through the opening 138B in the leftmost end of the tilt basket 42B and then through the opening 105B in the leftmost end of the guide member 44B.

As further partially illustrated in FIG. 3, the raise/lower cord 72A associated with the tilt basket 42A and guide member 44A passes upwardly through the bore 128 in the tilt basket 42A, and then passes through the opening 138B in the leftmost end of the tilt basket 42A and then through the opening 105B in the leftmost end of the guide member 44A. The raiser/lower cords 72B,C pass through the opening 105A in the rightmost end of the guide member 44A, and then together with the raise/lower cord 72A the raise/lower cords 72B,C then pass through the opening 138B in the leftmost end of the tilt basket 42A and then through the opening 105B in the leftmost end of the guide member 44A. Each successive tilt basket 42C, 42B, 42A thus adds a respective raise/lower cord 72C, 72B, 72A which passes through the remaining combinations of tilt baskets and guide members such that all three of the raise/lower cords 72A, 72B, 72C emerge from the leftmost end 90B of the guide member 44A as illustrated by example in FIGS. 8A and 8B.

Referring now to FIGS. 8A and 8B, the combination of the raise/lower cords 72A, 72B, 72C exiting the opening 105B in the leftmost end 90B of the guide member 44A passes at least partially around a rotatable wheel or roller 170 carried by the spacing member 50B and then through a channel defined between an inner wall 56B and a lower outer wall 56C of the spacer 56. The guide rod 52 illustratively passes through another channel defined between the inner wall 56B and an upper outer wall 56A of the spacer 56. In any case, the combination of the raise/lower cords 72A, B, C exiting the channel of the spacer 56 then passes at least partially around another spool 172 carried by the spool housing 68 and then back through the channel defined between the inner wall 56B and the lower outer wall 56C of the spacer 56, and is then attached to a mounting structure 174 carried by the spacing member 50B.

As described hereinabove, the guide structure 160, comprising the guide rod 52, spacer 50A, end cap 55, end cap 140, guide members 44A, 44B, 44C and guide rods 152B, 152C, is movable in the longitudinal or axial direction of the headrail 40 via corresponding longitudinal or axial movement of the internal actuator 54 as long the tilt baskets 42A, 42B, 42C do not impede such axial movement of the guide structure 160. Under such conditions, the magnetic force between the magnet or magnet assembly carried by the internal actuator 54, e.g., the two magnets 64A, 64B illustrated by example in FIG. 3, and the face 52A of the guide rod 52 causes the magnet or magnet assembly, e.g., the two magnets 64A, 64B, to drag the internal actuator 54 along the guide rod 52, i.e., and thus drag the entire guide structure 160 in and along the longitudinal or axial direction of the headrail 40. As described above with respect to FIGS. 4A-4C, such axial movement of the guide structure 160 when the stems 120B of the tilt baskets 42A-42C are positioned between the ends 96A, 96B of the channels 96 of the respective elongated guide members 44A-44C results in forward or rearward tilting of the blind slats 24 depending upon the direction of such axial movement of the guide structure 160.

However, when the stems 120B of the tilt baskets 42A-42C are in contact with one of the ends 96A, 96B of the channels 96 of the respective guide members 44A-44C, continued axial movement of the internal actuator 54 along the guide rod 52 in the direction which further forces the stems 120B of the tilt baskets 42A-42C against the one of the ends 96A, 96B of the channels 96 causes the magnet or magnet assembly carried by the upper housing 66 of the internal actuator 54, e.g., the two magnets 64A, 64B, to maintain magnetic adherence with the face 52A of the guide rod 52 but to also slide along the face 52A of the guide rod 52. The internal actuator 54 thus operates as a conventional clutch in that axial movement of the internal actuator 54 relative to the headrail 40 causes the guide rod 52, and thus the guide structure 160, to move axially relative to the headrail 40 as long as the tilt baskets 42A-42C do not impede such axial movement of the guide members 44A-44C (and thus axial movement of the entire guide structure 160), and also in that such axial movement of the internal actuator 54, when the tilt baskets 42A-42C do impede axial movement of the guide members 44A-44C, causes only the internal actuator 54 to move relative to, and axially along, the face 52A of the guide rod 52 (i.e., with the entire guide structure 160, including the guide rod 52, blocked from further axial movement). In the former case, the internal actuator "clutch" 54 is "engaged" with the guide rod 52 in the sense that movement of the actuator 54 causes the guide rod 52 to move therewith, and in the latter case the internal actuator "clutch" 54 is "disengaged" from the guide rod 52. in the sense that movement of the actuator causes the actuator 54 to move along the guide rod 52 even though the actuator 54 remains magnetically adhered thereto.

While such a clutch is illustrated in the attached figures, and has been described herein, in the form of a magnet or magnet assembly 64A, 64B and corresponding magnetic member in the form of a guide rod 52, such a clutch may otherwise be provided in the form of any conventional non-magnetic clutch structure. An example of one such alternative embodiment, which should not be considered limiting in any way, may illustratively include one or more springs operatively coupled to and between the actuator 54 and the guide rod 52 so as to provide friction between the actuator 54 and the guide rod 52 in an "engaged" position as long as the tilt baskets 42A-42C do not impede axial movement of the guide structure 160, and to cause the actuator 54 to ride along the rod in a "disengaged" position when the tilt baskets 42A-42C do impede axial movement of the guide structure 160. Those skilled in the art will recognize other conventional non-magnetic structures that may be implemented to provide the clutch function as just described, and it will be understood that any such conventional non-magnetic structures are contemplated by this disclosure and are therefore intended to fall within the scope of the claims appended hereto.

Depending upon the position of the actuator 54 relative to the guide rod 52 and upon the positions of elongated guide members 44A-44C relative to the tilt baskets 42A-42C, movement of the actuator 54 in the axial direction may result in tilting only of the blind slats 24, raising or lowering only of the blind slats 24 or both tilting and raising or lowering of the blind slats 24. Referring to FIG. 8B, for example, the actuator 54 is shown in a left-most extreme position in which the spool housing 68 abuts the free end of the spacer 56. In this position, the blind slats 24 are fully vertically lowered so that the bottom rail 25 is at its maximum distance below the headrail 40. This is the vertical position of the blind slats 24 (but not the tilt position) illustrated in FIG. 1. Further in this position of the actuator 54 illustrated in FIG. 8B, the elongated guide member 44A (and likewise the elongated guide members 44B and 44C) is in the extreme left-most position with the stem 120B of the tilt baskets 42A in contact with the right-most end 96A of the channel 96. As described above with respect to FIG. 4B, this represents the fully tilted forward position of the blind slats 24, and this tilt position of the blind slats 24 is partially illustrated in FIG. 8B. As further illustrated in FIG. 8B, the raise/lower cords 72A-72C include a length of slack 180 about the spool 172. Illustratively, the length of slack is selected to be that which allows the blind slats 24 to transition from their fully tilted forward position illustrated in FIG. 8B (and also illustrated in FIG. 4B) to their fully tilted rearward position (as illustrated in FIG. 4C) before the blind slats 24 begin to raise from their fully lowered position.

Referring again to FIG. 8A, the actuator 54 is shown to the right of and spaced apart from the spacer 56 such that the length of slack 180 in the raise/lower cords 72A-72C has been taken up by movement of the actuator 54 from its position illustrated in FIG. 8B to its position illustrated in FIG. 8A. As also shown in FIG. 8A, the elongated guide member 44A (and likewise the elongated guide members 44B and 44C) is in the extreme right-most position with the stem 120B of the tilt baskets 42A in contact with the left-most end 96B of the channel 96. As described above with respect to FIG. 4C, this represents the fully tilted rearward position of the blind slats 24, and this tilt position of the blind slats 24 is partially illustrated in FIG. 8A.

It will be noted that because the movement of the actuator 54 from the position illustrated in FIG. 8B to the position illustrated in FIG. 8A has moved the guide structure 160 so as to fully take up the length of the slack 180 in the raise/lower cords 72A-72C, such movement of the actuator 54 has only modified the tilt of the blind slats 24 from their fully tilted forward position (as shown in FIG. 8B) to their fully tilted rearward position (as shown in FIG. 8A) position without shortening the effective length of the raise/lower cords 72A-72C. As a result, such movement of the actuator 54 from the position illustrated in FIG. 8B to the position shown in FIG. 8A does not change the vertical position of the blind slats 24, and the blind slats 24 thus remain in their fully lowered position illustrated in FIG. 1.

Figure 9:
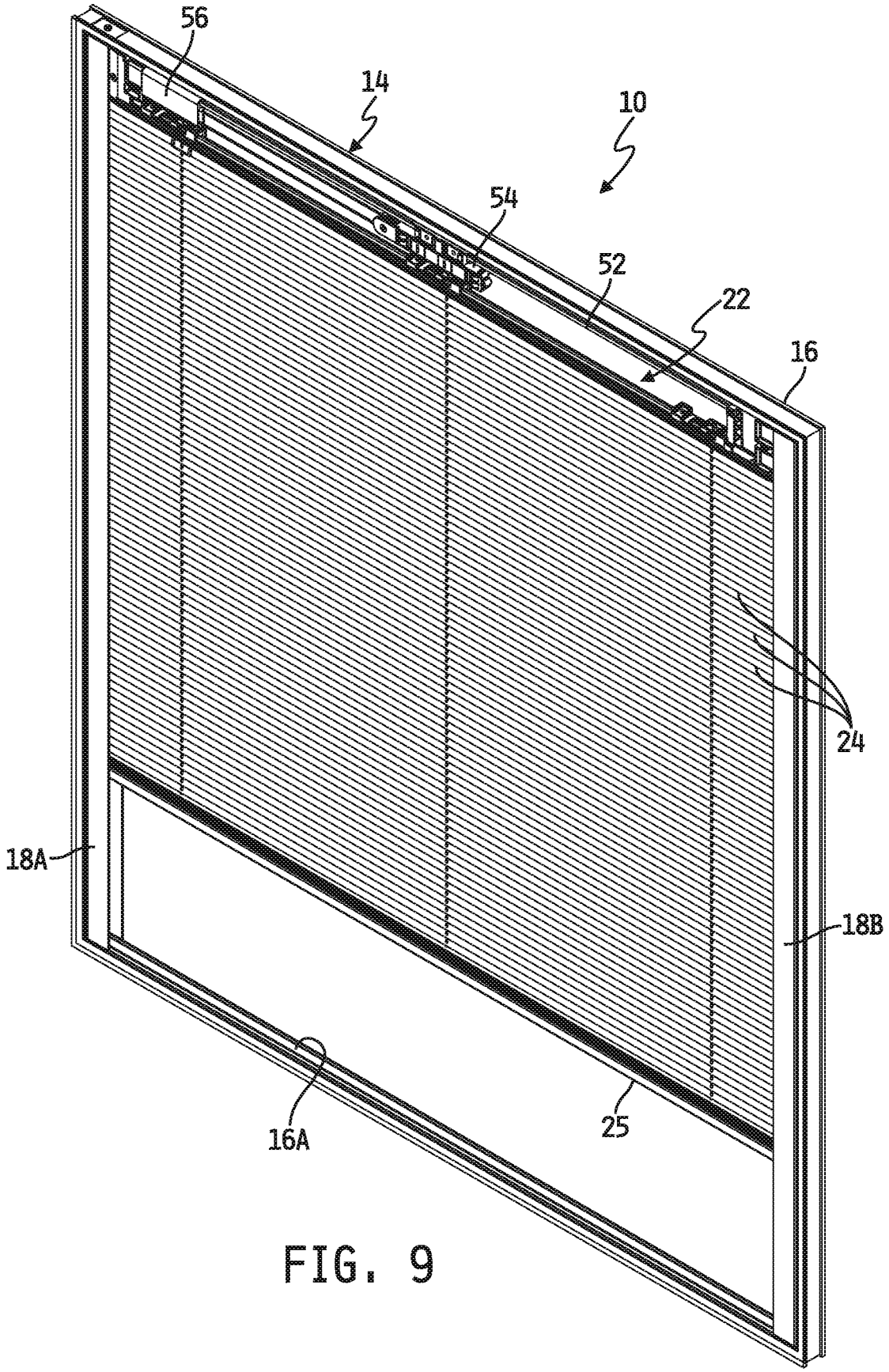
FIG. 9 is a front perspective view similar to FIG. 1 but with the control section housing and external actuator removed and illustrating the position of the internal actuator with the blind assembly partially raised.

Referring now to FIG. 9, the actuator 54 is shown moved from the position illustrated in FIG. 8A to a position well to the right of and spaced apart from the spacer 56. Because axial movement of the guide structure 160 to the right of the position shown in FIG. 8A is blocked by the tilt baskets 42 as shown and as described above, further movement of the actuator 54 to the right of the position shown in FIG. 8A causes the actuator 54 to cease moving the guide rod 52 and to instead move along the guide rod 52 as described above. Such movement of the actuator 54 along the guide rod 52 from the position shown in FIG. 8A to the position shown in FIG. 9 has thus decreased the effective length of the raise/lower cords 72A-72C as described above, thereby raising the blind assembly 12 as depicted in FIG. 9. Moreover, with the length of slack 180 in the raise/lower cords 72A-72C having been previously taken out by movement of the actuator 54 from the position shown in FIG. 8B to the position shown in FIG. 8A, movement of the actuator 54 to the left from the position illustrated in FIG. 9 will simultaneously cause the bind assembly 12 to lower and the tilt angle of the blind slats 24 to change from the fully tilted rearward position illustrated in FIG. 9 to a more forward tilt position. Generally, movement of the actuator 54 with no length of slack 180 in the raise/lower cords 72A-72C will cause simultaneous raising/lower of the blind assembly 12 and a change in the tilt angle of the blind slats 24 until the tilt baskets 42A-42C impede movement of the respective guide members 44A-44C. Thus, in any intermediate position of the blind slats 24 above their fully lowered position, movement of the actuator 54 to change the tilt angle of the blind slats 24 as described above will also result in some amount of raising or lowering of the blind assembly 12. It is only when the blinds assembly 12 is fully lowered and slack 180 is introduced does movement of the actuator 54 change only the tilt angle of the blind slats 24.

While the disclosure has been illustrated and described in detail in the drawings and foregoing description, such an illustration and description is to be considered as exemplary and not restrictive in character, it being understood that only illustrative embodiments have been shown and described and that all changes and modifications consistent with the disclosure and recited claims are desired to be protected.

What is claimed is:

1. A blind assembly for a window or door, comprising:

an elongated headrail extendable along or adjacent to a top of a window frame or a top edge of a window opening in a door, an elongated guide member carried by the elongated headrail, the elongated guide member defining a channel therethrough extending axially along the elongated guide member parallel with a longitudinal direction of the elongated headrail, the channel having a first terminal end and a second terminal end opposite the first terminal end, a tilt basket received within the channel and defining a bore therethrough substantially normal to the axial direction of the channel, first and second cords operatively engaging a number of blind slats, the first and second cords extending from the number of slats upwardly through the bore of the tilt basket with the first cord coupled to the elongated guide member adjacent to the first terminal end of the channel and the second cord coupled to the elongated guide member adjacent to the second terminal end of the channel, and an actuator to cause relative movement along the channel between the tilt basket and the elongated guide member to adjust a tilt angle of the number of slats between a full forward tilt with the tilt basket abutting the first terminal end of the channel and a full rearward tilt with the tilt basket abutting the second terminal end of the channel.

2. The blind assembly of claim 1, further comprising:

an elongated bottom rail opposite the elongated top rail with the number of slats positioned between the elongated top rail and the elongated bottom rail, and a third cord having one end coupled to the elongated bottom rail with an opposite end extending upwardly through the bore of the tilt basket and coupled to the actuator, wherein the actuator is movable relative to the elongated top rail to adjust the tilt angle of the number of slats and to raise and lower the elongated bottom rail.

3. The blind assembly of claim 1, wherein the tilt basket is non-movably mounted to the elongated headrail and the elongated guide member is movable by the actuator relative to the tilt basket.

4. The blind assembly of claim 1, wherein the elongated guide member is non-movably mounted to the elongated headrail and the tilt basket is movable by the actuator relative to the elongated guide member.

5. The blind assembly of claim 1, further comprising:

an elongated bottom rail opposite the elongated top rail with the number of slats positioned between the elongated top rail and the elongated bottom rail, and a third cord having one end coupled to the elongated bottom rail with an opposite end extending upwardly through the bore of the tilt basket and coupled to the actuator, wherein the actuator is coupled via a clutch to one of the elongated guide member and the tilt basket, wherein, with the tilt basket positioned between the first and second terminal ends of the channel, the clutch is engaged such that movement of the actuator moves the one of the elongated guide member and the tilt basket to effect the relative movement along the channel between the tilt basket and the elongated guide member to adjust the tilt angle of the number of slats, and wherein, with the tilt basket abutting the first terminal end of the channel, movement of the actuator in a first direction that forces the tilt basket against the first terminal end of the channel disengages the clutch such that further movement of the actuator in the first direction raises the elongated bottom rail toward the elongated top rail, and wherein, with the tilt basket abutting the second terminal end of the channel, movement of the actuator in a second direction that forces the tilt basket against the second terminal end of the channel disengages the clutch such that further movement of the actuator in the second direction lowers the elongated bottom rail away from the elongated top rail.

6. The blind assembly of claim 5, wherein the elongated bottom rail has a fully lowered position below which the elongated bottom rail cannot be extended away from the elongated top rail, and wherein third cord includes a length of slack between the elongated bottom rail and the actuator with the elongated bottom rail in the fully lowered position, and wherein the length of slack is sized such that movement of the actuator with the elongated bottom rail in the fully lowered position and with the tilt basket positioned between the first and second terminal ends of the channel moves the one of the elongated guide member and the tilt basket to effect relative the movement along the channel between the tilt basket and the elongated guide member to adjust the tilt angle of the number of slats while taking up or introducing additional slack in the third cord so as to not raise or lower the elongated bottom rail.

7. The blind assembly of claim 6, wherein movement of the actuator with the elongated bottom rail raised to any position at or above a threshold distance from the fully lowered position and with the tilt basket positioned between the first and second terminal ends of the channel simultaneously moves the one of the elongated guide member and the tilt basket to effect the relative movement along the channel between the tilt basket and the elongated guide member to adjust the tilt angle of the number of slats and the third cord so as to raise or lower the elongated bottom rail.

8. The blind assembly of claim 5, further comprising a first magnetic member coupled to the one of the elongated guide member and the tilt basket, wherein the clutch comprises at least a first magnet carried by the actuator and magnetically coupled to the first magnetic member such that movement of the actuator with the clutch engaged moves the first magnetic member and such that movement of the actuator with the clutch disengaged moves the actuator along and relative to the first magnetic member.

9. The blind assembly of claim 1, wherein the elongated headrail is configured to be mounted within an insulating glass unit (IG), and wherein the IG is mountable within the window frame or the window opening in a door.

10. The blind assembly of claim 9, wherein the actuator comprises:

a first actuator component within the IG and including, and a second actuator component external to the IG, wherein one of the first and second actuator components includes at least a second magnet and the other of the first and second actuator components includes a second magnetic member, and wherein the first and second actuator components are coupled together through the IG via magnetic coupling between the at least the second magnet and the second magnetic member such that movement of the second actuator component along an external surface of the IG moves the first actuator component along therewith.

11. The blind assembly of claim 1, wherein the window frame or the window opening in a door has at least one window pane mounted therein, and wherein the elongated headrail is configured to be mounted to and along the top of the window frame or the top edge of the window opening in a door adjacent to the window pane.

12. The blind assembly of claim 1, wherein the window frame or the window opening in a door has an insulating glass unit (IG) mounted therein, and wherein the elongated headrail is configured to be mounted to and along the top of the window frame or the top edge of the window opening externally to the 1G.

13. A blind assembly for a window or door, comprising:

an elongated headrail extendable along or adjacent to a top of a window frame or a top edge of a window opening in a door, a plurality of tilt baskets spaced apart along and non-movably mounted to the elongated headrail, each of the plurality of tilt baskets defining a bore therethrough, a plurality of elongated guide members each defining a channel therethrough extending axially therealong parallel with a longitudinal direction of the elongated headrail, each channel having a first terminal end, a second terminal end opposite the first terminal end and one of the plurality of tilt baskets received therein with the bore defined therethrough substantially normal to the axial direction of the channel, a plurality of sets of first and second cords operatively engaging a number of blind slats, each of the plurality of sets of first and second cords extending from the number of slats upwardly through the bore of a different one of the plurality of tilt baskets with the first cord coupled to a corresponding one of the plurality of elongated guide members adjacent to the first terminal end of the channel defined therethrough and the second cord coupled to the corresponding one of the plurality of elongated guide members adjacent to the second terminal end of the channel defined therethrough, and an actuator to cause relative movement along the channels between the plurality of tilt baskets and corresponding ones of the plurality of elongated guide members to adjust a tilt angle of the number of slats between a full forward tilt with each of the plurality of tilt baskets abutting the first terminal end of the channel defined through a corresponding one of the plurality of elongated guide members and a full rearward tilt with each of the plurality of tilt baskets abutting the second terminal end of the channel defined through a corresponding one of the plurality of tilt baskets.

14. The blind assembly of claim 13, further comprising:

an elongated bottom rail opposite the elongated top rail with the number of slats positioned between the elongated top rail and the elongated bottom rail, and a plurality of third cords each having one end coupled to the elongated bottom rail with an opposite end extending upwardly through the bore of a different one of the plurality of tilt baskets and coupled to the actuator, wherein the actuator is movable relative to the elongated top rail to adjust the tilt angle of the number of slats and to raise and lower the elongated bottom rail.

15. The blind assembly of claim 13, wherein the elongated headrail is configured to be mounted within an insulating glass unit (IG), and wherein the IG is mountable within the window frame or the window opening in a door.

16. The blind assembly of claim 15, wherein the actuator comprises:

a first actuator component within the IG and including, and a second actuator component external to the IG, wherein one of the first and second actuator components includes at least a first magnet and the other of the first and second actuator components includes a first magnetic member, and wherein the first and second actuator components are coupled together through the IG via magnetic coupling between the at least the first magnet and the first magnetic member such that movement of the second actuator component along an external surface of the IG moves the first actuator component along therewith.

17. The blind assembly of claim 13, wherein the window frame or the window opening in a door has at least one window pane mounted therein, and wherein the elongated headrail is configured to be mounted to and along the top of the window frame or the top edge of the window opening in a door adjacent to the window pane.

18. The blind assembly of claim 13, wherein the window frame or the window opening in a door has an insulating glass unit (IG) mounted therein, and wherein the elongated headrail is configured to be mounted to and along the top of the window frame or the top edge of the window opening externally to the IG.

19. The blind assembly of claim 13, wherein the elongated bottom rail has a fully lowered position below which the elongated bottom rail cannot be extended away from the elongated top rail, and wherein a third cord includes a length of slack between the elongated bottom rail and the actuator with the elongated bottom rail in the fully lowered position, and wherein the length of slack is sized such that movement of the actuator with the elongated bottom rail in the fully lowered position and with each of the plurality of tilt baskets positioned between the first and second terminal ends of the channel of a corresponding one of the plurality of elongated guide members moves each of the plurality of elongated guide members relative to a corresponding one of the plurality of tilt baskets to adjust the tilt angle of the number of slats while taking up or introducing additional slack in the third cord so as to not raise or lower the elongated bottom rail.

20. The blind assembly of claim 19, wherein movement of the actuator with the elongated bottom rail raised to any position at or above a threshold distance from the fully lowered position and with each of the plurality of tilt baskets positioned between the first and second terminal ends of the channel of a corresponding one of the plurality of elongated guide members simultaneously moves each of the plurality of elongated guide members relative to a corresponding one of the plurality of tilt baskets to adjust the tilt angle of the number of slats and the third cord so as to raise or lower the elongated bottom rail.

21. The blind assembly of claim 13, further comprising a second magnetic member coupled to each of the plurality of elongated guide members, and a clutch comprising at least a second magnet carried by the actuator and magnetically coupled to the second magnetic member such that movement of the actuator with the clutch engaged moves the second magnetic member and such that movement of the actuator with the clutch disengaged moves the actuator along and relative to the second magnetic member.

* * * * *